US009421808B2

(12) United States Patent
Ferrar et al.

(10) Patent No.: US 9,421,808 B2
(45) Date of Patent: Aug. 23, 2016

(54) INKJET RECEIVER PRECOATS INCORPORATING SILICA

(71) Applicants: Wayne Thomas Ferrar, Fairport, NY (US); Thomas Joseph Dannhauser, Pittsford, NY (US); Raouf Botros, Centerville, OH (US); Peter G. Bessey, Clifton Springs, NY (US); Hwei-Ling Yau, Rochester, NY (US)

(72) Inventors: Wayne Thomas Ferrar, Fairport, NY (US); Thomas Joseph Dannhauser, Pittsford, NY (US); Raouf Botros, Centerville, OH (US); Peter G. Bessey, Clifton Springs, NY (US); Hwei-Ling Yau, Rochester, NY (US)

(73) Assignee: EASTMAN KODAK COMPANY, Rochester, NY (US)

( * ) Notice: Subject to any disclaimer, the term of this patent is extended or adjusted under 35 U.S.C. 154(b) by 501 days.

(21) Appl. No.: 13/851,182

(22) Filed: Mar. 27, 2013

(65) Prior Publication Data

US 2014/0292951 A1 Oct. 2, 2014

(51) Int. Cl.
*B41M 5/52* (2006.01)
*B41M 5/50* (2006.01)

(52) U.S. Cl.
CPC ..... *B41M 5/502* (2013.01); *B41M 5/52* (2013.01); *B41M 5/508* (2013.01); *B41M 5/5218* (2013.01); *B41M 5/5245* (2013.01); *B41M 5/5254* (2013.01)

(58) Field of Classification Search
None
See application file for complete search history.

(56) References Cited

U.S. PATENT DOCUMENTS

| | | | | |
|---|---|---|---|---|
| 4,513,301 | A | 4/1985 | Takayama et al. | |
| 4,554,181 | A | 11/1985 | Cousin et al. | |
| 6,207,258 | B1 | 3/2001 | Varnell | |
| 6,238,047 | B1 | 5/2001 | Suzuki et al. | |
| 7,199,182 | B2 | 4/2007 | Tanaka et al. | |
| 7,618,692 | B2 * | 11/2009 | Nakano | B41M 5/5218 427/146 |
| 8,016,404 | B2 | 9/2011 | Kato et al. | |
| 8,092,874 | B2 | 1/2012 | Wesler et al. | |
| 8,114,486 | B2 | 2/2012 | Nelli | |
| 2004/0241351 | A1 | 12/2004 | Sharmin et al. | |
| 2009/0074995 | A1 | 3/2009 | Dannhauser et al. | |
| 2011/0050827 | A1 | 3/2011 | Romano, Jr. et al. | |
| 2011/0244148 | A1 | 10/2011 | Zhous et al. | |
| 2011/0279554 | A1 | 11/2011 | Dannhauser et al. | |
| 2012/0012264 | A1 | 1/2012 | Zhou et al. | |
| 2012/0034398 | A1 | 2/2012 | Wang et al. | |
| 2013/0257988 | A1 * | 10/2013 | Xiang et al. | 347/43 |

OTHER PUBLICATIONS

H.K. Lee, et al, TAPPI Journal; vol. 4, No. 2, Feb. 2005, pp. 11-16.

* cited by examiner

*Primary Examiner* — An Do
*Assistant Examiner* — Renee I Wilson
(74) *Attorney, Agent, or Firm* — Raymond L. Owens; J. Lanny Tucker

(57) ABSTRACT

An inkjet receiving media comprising a substrate having a transparent topmost layer coated thereon at solid content of from 0.3 to 2.5 g/m$^2$, wherein the topmost layer includes from 30-70 wt % of one or more aqueous soluble salts of multivalent metal cations, 5 to 20 wt % of a cross-linked hydrophilic polymer binder, 4 to 12 wt % of a cationic polymer to stabilize 10 to 40 wt % silica that is less than 200 nm is size. Improved optical density, reduced mottle and improved wet abrasion resistance are provided when the receiver is printed with an aqueous pigment-based ink. In further embodiments, the topmost layer can further include high levels of silica that makes the layer porous.

31 Claims, No Drawings

INKJET RECEIVER PRECOATS INCORPORATING SILICA

FIELD OF THE INVENTION

The invention relates generally to the field of inkjet, and in particular to inkjet recording media, a printing system, and to a printing method using such media. More specifically, the invention relates to inkjet recording media ranging from a water resistant to a highly water-absorbent substrate and an image-enhancing transparent surface treatment or layer containing silica in a high salt environment.

BACKGROUND OF THE INVENTION

The present invention is directed in part to overcoming the problem of printing on glossy or semi-glossy coated papers or the like with aqueous inkjet inks. Currently available coated papers of this kind have been engineered over the years to be compatible with conventional, analog printing technologies, such as offset lithography, and can be designated as "offset papers." The printing inks used in offset printing processes are typically very high solids, and the solvents are typically non-aqueous. As a consequence, the coatings that are currently used to produce glossy and semi-glossy offset printing papers, such as those used for magazines and mail order catalogs, have been intentionally designed to be resistant to the absorption of water. In fact, when these papers are characterized by standard tests as to their porosity or permeability, they have been found to be much less permeable than a typical uncoated paper.

In contrast to lithographic inks, inkjet inks are characterized by low viscosity, low solids, and aqueous solvent. When such coated offset papers are printed with inkjet inks that comprise as much as 90-95% water as the carrier solvent, the inks have a tendency to sit on the surface of the coating, rather than penetrate into the coating or underlying paper substrate.

Because the inks printed on a water-resistant receiver should dry primarily by evaporation of the water without any significant penetration or absorption of the water into the coating or paper, a number of problems are encountered. One such problem is that the individual ink droplets slowly spread laterally across the surface of the coating, eventually touching and coalescing with adjacent ink droplets. This gives rise to a visual image quality artifact known as "coalescence" or "puddling." Another problem encountered when inks dry too slowly is that when two different color inks are printed next to each other, such as when black text is highlighted or surrounded by yellow ink, the two colors tend to bleed into one another, resulting in a defect known as "intercolor bleed." Yet another problem is that when printing at high speed, either in a sheet fed printing process, or in a roll-to-roll printing process, the printed image is not dried sufficiently before the printed image comes in contact with an unprinted surface, and ink is transferred from the printed area to the unprinted surface, resulting in "ink retransfer."

In contrast to glossy offset papers, some coated papers for offset lithography have matte surfaces that are very porous. While high-solids lithographic inks remain on the surface, the colorant of aqueous inkjet inks on the other hand tends to absorb deeply into the paper, resulting in a substantial loss of optical density and as a consequence, reduced color gamut.

Recently high speed continuous inkjet printing processes have been developed that are suitable for high speed, midvolume printing and have become of interest to the commercial printing industry. As commercial offset papers are manufactured in high volume, it would be preferable to be able to use such offset papers themselves for commercial inkjet printing purposes, to take advantage of economies of scale. For the several reasons discussed above, however, the standard preparation of substrates for offset lithographic printing renders them unsuitable for printing with aqueous inkjet inks. Thus the need arises for inkjet-printable receivers providing the familiar look and feel, as well as economical cost of standard lithographic printing-grade offset papers.

The requirements of commercial printing industry include, among others, image quality in terms of high optical density, broad color gamut, sharp detail, and minimal problems with coalescence, smearing, feathering and the like. Operationally, the printing process strives for low environmental impact, low energy consumption and fast drying. The resulting print should exhibit durability, resisting abrasion when dry or if wetted.

Simply omitting the water-resistant coating of a glossy lithographic offset paper does not enable high-quality inkjet printing. Uncoated paper does not maintain the ink colorant at the surface, but permits significant penetration of the colorant into the interior of the paper, resulting in a loss of optical density and a low-quality image. Moreover, ink penetrates non-uniformly into the paper due to the heterogeneous nature of the paper, giving rise to mottle, which further degrades the image.

Very high quality photopapers have been developed for desktop consumer inkjet printing systems incorporating relatively high laydown ink-receiving layers that are porous or permeable to the ink. However, such coated photopapers are generally not suitable for high-speed commercial inkjet printing applications for a number of reasons. The thick coatings result in a basis weight that is impractically heavy for mailing or other bulk distribution means. Such receivers are not meant for rough handling or folding, which would result in cracking of the coated layers. In general, these coated photopapers are too expensive for high-speed inkjet commercial printing applications, such as magazines, brochures, catalogs, and the like. This is because such coated photopapers require either expensive materials, such as fumed oxides of silica or alumina, to produce a glossy surface or very thick coatings to adequately absorb the relatively heavy ink coverage required to print high quality photographs.

Multivalent metal salts are known to improve the print density and uniformity of images formed on plain papers from inkjet printers. For example, Cousin, et al., in U.S. Pat. No. 4,554,181, disclose the combination of a water-soluble salt of a polyvalent metal ion and a cationic polymer at a combined dry coat weight of 0.1 to 15.0 g/m$^2$, for improving the print density of images printed by inkjet printers employing anionic dye-based inks. Low coating coverages in layers comprising a cross-linked hydrophilic polymer are not disclosed.

Varnell, in U.S. Pat. No. 6,207,258, discloses the use of water-soluble salts of multivalent metal ions combined with a polymeric sizing agent and a carrier agent in a size press to improve the print density and uniformity of images formed on plain papers from inkjet printers employing pigment colorants in the ink set. The actual surface concentrations are not readily apparent from the disclosure of the size-press application method.

Takayama, et al., in U.S. Pat. No. 4,513,301 disclose a heat sensitive recording material comprising a binder of acetoacetylated PVA at 2 to 12 g/m$^2$, but do not suggest its use as an inkjet receiver. Among two dozen suggested organic and inorganic curing agents for the binder, glyoxal and calcium chloride are disclosed. No suggestion of utility for inkjet recording is provided.

Suzuki, et al., in U.S. Pat. No. 6,238,047, disclose an inkjet receiver for pigment ink comprising a substrate, a layer of alumina hydrate and an upper layer of water-soluble polymer of approximately 0.01 to 50 g/m$^2$. Sharmin, et al., in US application 2004/0241351, disclose an inkjet receiver with a porous layer adjacent a support, and above the porous layer, a swellable layer comprising a hydrophilic polymer of about 0.5 to 5 g/m$^2$.

Tanaka, et al., in U.S. Pat. No. 7,199,182, disclose an inkjet recording material comprising an impervious substrate coated with at least 20 g/m$^2$ of an aqueous resin composition comprising a water soluble magnesium salt, an aqueous polyurethane, and one or more of a cationic compound (such as a cationic polymer), a nonionic water soluble high molecular weight compound (such as acetoacetylated poly(vinyl alcohol) (PVA acac)), and a water soluble epoxy compound.

Dannhauser and Campbell in US Patent Application 20110279554 describe an inkjet receiver with a thin topcoat of multivalent metal cation in a crosslinked hydrophilic polymer binder. Improved optical density, reduced mottle and improved wet abrasion resistance are provided when the receiver is printed with an aqueous pigment-based ink.

The advantages of silica and alumina overcoats for inkjet printing using PVA as a binder are described in the article by H. K. Lee, M. K. Joyce, P. D. Fleming, J. E. Cawthrone; TAPPI Journal; Vol 4, No. 2, February, 2005; p 11. A more recent description using cationic silica for ink jet coatings is described by Kato and Nishizaki in U.S. Pat. No. 8,016,404. These precoats tend to be several microns in thickness and are evaluated with consumer inkjet printers.

A two step process where a multivalent salt is first coated onto a porous receiver before a second layer of a non-ionic binder and anionic particles is described by Dannhauser, Bugner, and Girolmo of Kodak in US2009/0074995. The anionic particles include silicas of various types including colloidal silica. Solution instability is avoided by keeping the salt separated from the charge particles.

Cationic silicas from Nissan have been claimed in U.S. Pat. No. 8,016,404B2 as pretreatment fluids for inkjet receivers. Multivalent metal salts were not included in the layer.

U.S. Pat. No. 8,114,486 to Evonik Degussa reports improved image quality of inkjet paper with a silica coating of greater than 1 g/m$^2$. The coating includes precipitated silica, colloidal silica, fumed silica of fumed metal oxide in a PVA binder along with a cationic polymer such as poly (DADMAC). Multivalent metal salts are not added to the coating.

U.S. Pat. No. 8,092,874 by Wexler and Reczek for Kodak details improved image quality using complexes of polyvalent metal cations with organic ligands. The metal complexes were used in place of metal salts. PVA is used as the binder for fumed silica and clay particles.

US Patent Application 2012/0034398 describes an ink receptive layer that contains mostly inorganic pigments such as clays, calcium carbonate, talc, alumina, and zeolytes that make up 70 to 85 weight percent of the coating. Silica particles with a large surface area such as fumed silica, precipitated silica, or synthetic silica can also add up to 3 weight percent of the coating. A binder such as PVA can also be used between 4 and 25 weight percent, and metallic salts including calcium chloride between 5 and 25 weight percent of the coating US Patent Application 2012/0012264 describes an ink receptive layer that contains two different binders, one of which is PVA the other polymeric latex. Also present are "white inorganic pigments" such as calcium carbonate and aluminum silicate particles to increase the opacity. Metallic salts, including calcium chloride, are also added as an ink fixative, but too high a level leads to instability in the coating dispersion.

US application 2011/0244148 employs calcium chloride in a polymeric binder with inorganic particles and optical brighteners to form a thick layer over paper for inkjet receivers. These suspensions can contain colloidal silica or alumina in combination with other low surface area oxides such as clay, kaolin, calcium carbonate, titanium dioxide, and zeolites. The surface characteristics of the paper are controlled by the coating, including the gloss on the paper.

US application 2011/0050827 cationic silica gel, PVA binder, and calcium chloride. The silica particles are orders of magnitude larger than colloidal silica and required calendaring to achieve ink jet papers with high gloss levels.

SUMMARY OF THE INVENTION

It is a primary objective of one embodiment of this invention to enable the printing at high speed using aqueous inkjet inks, of glossy, semi-glossy and matte coated lithographic offset papers with high image quality, high optical density, and physical durability, including resistance to wet or dry abrasion, water-fastness, and resistance to smearing from subsequent highlighter marking. Improved optical density, reduced mottle and improved wet abrasion resistance are provided when the receiver is printed with an aqueous pigment-based ink.

Briefly summarized, according to one aspect of the present invention, an inkjet receiving element comprising a substrate having coated thereon a transparent topmost layer, wherein the topmost layer comprises:

(a) from 30 to 70 wt % of one or more aqueous soluble salts of multivalent metal cations, (b) from 5 to 20 wt % of a cross-linked hydrophilic polymer binder, (c) from 10 to 40 wt % of silica particles, and (d) from 4 to 12 wt % of a cationic polymer, wherein the silica particles have an average particle size less than 200 nm, wherein the weight ratio of cationic polymer to silica is in the range of 1:1 to 1:6, and wherein the topmost layer is present at a dry coverage in the range of 0.3 to 2.5 g/m$^2$.

In further embodiments, the topmost layer can further include salt, binder, stabilizing polymer and silica for improved scratch resistance or porosity.

Another aspect of the present invention is directed to a method of printing in which the above-described inkjet receiving medium is printed with an inkjet printer employing at least one pigment-based colorant in an aqueous ink composition.

In a further embodiment, the present invention provides a printing method comprising transporting an inkjet receiving medium of the invention by a continuous inkjet printhead applying an inkjet ink onto the receiving medium comprising at least one pigment based colorant in an aqueous ink composition, and subsequently transporting the printed receiving medium through a drying station.

Advantages of various embodiments of the invention include: high printed image quality including high pigment density and color gamut, and low grain and mottle; improved print durability to dry rub, wet abrasion, scratch resistance, porosity and highlighter marking; ability to provide surface types including glossy, semi-glossy, dull matte and clear films; and extremely low coverage permitting easy application and low cost.

DETAILED DESCRIPTION OF THE INVENTION

Preventing Collapse of Oxide Surface Charge in Salt Solutions with Polymeric Stabilizers.

As detailed in US Patent Application 2011/0279554 to Dannhauser, inkjet receiving media have applied to the receiver a topmost layer coated thereon at solid content of from 0.1 to 2.5 g/m$^2$, wherein the topmost layer includes from 30 to 70 wt % of one or more aqueous soluble salts of multivalent metal cations and at least 0.05 g/m$^2$ of a cross-linked hydrophilic polymer binder. This can result in improved optical density, reduced mottle and improved wet abrasion resistance when the receiver is printed with an aqueous pigment-based ink. These precoats generally relate to commercial inkjet printing. Incorporation of inorganic oxides into these polymeric layers would increase the mechanical properties and improve the print quality, as is the case with home, photo quality inkjet receivers discussed above. Unfortunately our attempts to incorporate inorganic oxides into these high salt precoats were unsuccessful. The addition of 2 wt % colloidal silica to an aqueous precoat solution containing 10 wt % calcium chloride resulted in precipitation of the oxide. This was true for several types of colloidal silica, having both negative and positive charge. Addition of various binder polymers that improve mechanical properties of the precoats did not help the dispersion stability. For example, PVA did not add stability to the silica/$CaCl_2$ dispersion. Neither the rates nor order of addition, or changes in pH of the components had any benefit in terms of stabilizing the oxide.

Stabilizing Polymers

Stable precoat dispersions of silica in calcium chloride dissolved in water were achieved by first treating the silica with the amine containing polymer PEI (Structure 1). The polymer solutions were adjusted to pH 4 by the addition of an acid, generally HCl. After stirring for at least two hours, the dropwise addition of solutions of PVA binder polymer, crosslinker, and a 40 wt % solution of calcium chloride resulted in dispersions that were stable against gelling or precipitation. The dispersions were generally stirred at least overnight before coating onto paper.

High molecular weight PEI generally preformed better than lower molecular weight polymer. The PEI was obtained from Sigma-Aldrich as a 50 wt % solution in water, typical $M_n$ 60,000 by gel permeation chromatography and $M_w$ 750,000 by light scattering. A similar material was also obtained from BASF as Lupasol® P.

Structure 1

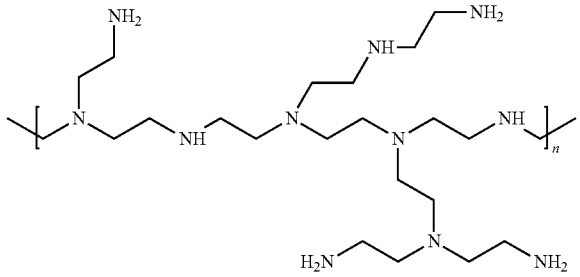

Polyethyleneimine (PEI) which is acidified before addition of Ludox® CL—P and calcium chloride solution.

The PEI can stabilize both cationic and anionic silica. The cationic silica used in this work is a colloidal silica from WR Grace Company called Ludox® CL-P, a synthetic amorphous silica with a primary particle size of 22 nm. It is cationic in nature due to the surface coverage with alumina. Ludox® CL is a similar cationic silica with a primary particle size of 12 nm. Cationic silica is more readily stabilized in salt solution than the more common anionic silica. Focusing on cationic silica enables the use of PEI based copolymers to prevent the particles from precipitating in the calcium chloride precoat solutions. PEI copolymers are commonly used in the paper industry and are less expensive than PEI homopolymers. Examples of such polymers are Polymin® SK from BASF and HM Polymin® from BASF. The copolymers need to be acidified before they are mixed with the cationic silica. These copolymers require less acid to acidify than the PEI homopolymer, probably because the other segments of the copolymer do not contain the quaternizable amine functionalities. Other cationic polymers will also stabilize the cationic silica in the calcium chloride. Catiofast® 159A is also a polyamine solution polymer used in the paper industry (Structure 2). It is a viscous solid that flows when it is isolated. The structure is provided by the manufacturer BASF.

Structure 2

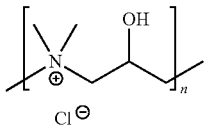

Catiofast® 159A, which is available as a 50% aqueous solution.

Two other polymers with a high degree of cationic functionality that were found will stabilize cationic silica in high salt solutions are poly(diallyldimethylammonium chloride), poly(DADMAC) (Structure 3) and the related copolymer poly(acrylamide-co-diallyldimethylammonium chloride), poly(AADAD) (Structure 4).

Structure 3

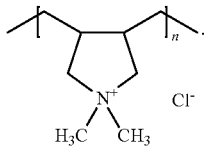

poly(diallyldimethylammonium chloride; poly(DADAMC)

Structure 4

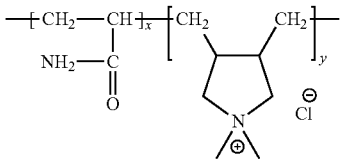

poly(AADAD)

Negatively charged silica was more difficult to stabilize in the high salt precoat solution than the cationic silica. However, prolonged stirring or heating of the stabilizing polymer with the negatively charged colloidal silica gave stable dispersions that when coated and printed showed effective image quality and durability. The ability to stabilize negatively charged colloidal silica is important because it is more common and less expensive than silica that has been previously treated with aluminum compounds to make the surface cationic.

The ratios of the stabilizing polymers to oxides were from 1:1 to 1:6 by weight. Higher salt levels and anionic silica both required more sequestering agent to stabilize the silica. In general salt levels near 70 wt % of the total dry coatweight required the PEI based polymer to be in the 1:1 to 1:3 polymer to silica by weight range. The silica content of these coatings was on the lower part of the range at about 10 wt %. These coatings generally produced images with superior image quality and mechanical abrasion properties.

Higher levels of silica generally produced porous coating with superior dry times. Higher silica contents of about 40 wt % of the dry coating laydown necessitate a lower level of salt in the coated layer; multivalent salt levels were as low as 30 wt %. At these lower salt levels, less stabilization is required for the silica; the polymer stabilizer to silica ratio was reduced to levels as low as 1:6 for 30 wt % calcium chloride dispersions.

A characteristic of these silica containing dispersions is that they produce clear and transparent coatings. This is due to the small size of the inorganic particles, which are nanometers in size. Colloidal silica particles generally come in aqueous dispersions that are transparent, even when the concentration is 40 wt % silica. The manufacturers of the colloidal silica report particle sizes of less than 50 nm. Particle size measurements on the silica in the precoat formulations found the particle size increased when the salt was added to the dispersion, but the particle size remained 150 nm. Thus the small particle size is an important characteristic of these precoats and differentiates colloidal silica from other larger inorganic particles. Fumed silica can also be applicable to these formulations. Application of these silica-containing precoats to did not change the appearance of the paper over which they were applied. For example the gloss and color of the paper showed little or no change after the precoat was applied. The clarity of the layer is an important attribute of these coatings.

Alumina

The tendency for PEI to bind to inorganic oxides has been exploited by others. Alumina was used as a template for the bonding of PEI to prepare catalyst supports for peptide synthesis (W. E. Meyers, G. P. Royer, *J. Am. Chem. Soc.* 1977, 99, 6141.) The same research group later used silica as the template for the PEI binding. (D. R. Coleman, G. P. Royer, *J. Org. Chem.* 1980, 45, 2268) In both of these cases the oxide was dissolved away using strong base to leave the PEI as a support for an ion exchange resin.

Alumina particles are also stabilized by PEI in divalent salt solutions. Although pseudo-boehmite particles generally are cationic and do not physically precipitate as readily as the silica when calcium chloride is added to the dispersion, the salt causes the viscosity to rise and the dispersion becomes difficult to coat onto a substrate. The PEI stabilizes the alumina and results in coatings that are less hazy than alumina-calcium chloride dispersions that do not contain the PEI acidified polymers. Combining silica particles with a lesser amount of alumina particles can provide advantages to increase the toughness of the coating. Colloidal silica particles are generally less than 50 nm while the boehmite alumina particles can be in agglomerates of 300 nm. Mixing the two particle sizes can have advantages over coatings made with each separately.

Lithographic coated offset papers typically comprise a paper base which has been coated with clay or the like and undergone surface calendaring treatment to provide a desired surface smoothness. The invention applies to the use of both glossy and matte coated offset papers. Advantageously, the relatively low coating weights of the topmost layer of the inkjet receiving medium of the invention helps maintain the relative glossy or matte surface of the employed substrate. Such coated offset papers employable as the substrate of the inkjet receiving medium of the invention can be obtained from various commercial paper manufacturers, including, e.g., International Paper, Sappi, New Page, Appleton Coated, Abitibi-Bowater, Mohawk Papers, Verso, Mitsubishi, Norpac, Domtar, and many others. Specific examples include, e.g., STERLING ULTRA GLOSS paper (80 lb basis weight), a coated glossy offset paper for lithographic printing manufactured by NewPage, and UTOPIA BOOK (45 lb. basis weight), available from Appleton Coated, a coated matte offset paper.

In various embodiments, the substrate is readily hydrophilic and capable of adsorbing and transferring ink colorant to the substrate interior prior to being coated thereon with the topmost layer of the invention, such as wherein the substrate can be porous. Unfortunately the topcoats that include salts and polymer generally retard the migration of the water to the substrate below. The result is longer drying times and unwanted transfer of the image to the facing sheet in a printed roll. These problems are mitigated by rendering the topcoat porous with the inorganic oxides. Incorporation of high levels of silica will render the topcoat porous to the aqueous ink. The porosity imparted by the silica permits the water of the ink to drain through the topcoat into the porous substrate. The porosity results in faster drying times for the ink-jet prints made on the substrates coated with silica. Alternatively, the substrate is substantially impermeable to water or aqueous ink, such as a non-porous plastic film. In a particular preferred embodiment, the invention is particularly useful wherein the substrate includes a relatively hydrophobic coated surface prior to being coated thereon with the topmost layer, and the topmost layer provides a continuous relatively hydrophilic surface. An advantage is observed by incorporating silica into the topcoat to impart porosity into the layer.

While the invention is in certain embodiments directed towards the use of coated offset papers as the substrate, the topmost layer of the invention can also be used in combination with uncoated offset paper or other plain papers. Further, the invention can also be used with any of those supports typically used for inkjet receivers, such as resin-coated paper, polyesters, or microporous materials such as polyethylene polymer-containing material sold by PPG Industries, Inc., Pittsburgh, Pa. under the trade name of TESLIN, TYVEK synthetic paper (DuPont Corp.), and OPPALYTE films (Mobil Chemical Co.) and other composite films listed in U.S. Pat. No. 5,244,861. Opaque supports include plain paper, coated paper, synthetic paper, photographic paper support, melt-extrusion-coated paper, and laminated paper, such as biaxially oriented support laminates.

Biaxially oriented support laminates are described in U.S. Pat. No. 5,853,965, U.S. Pat. No. 5,866,282, U.S. Pat. No. 5,874,205, U.S. Pat. No. 5,888,643, U.S. Pat. No. 5,888,681, U.S. Pat. No. 5,888,683, and U.S. Pat. No. 5,888,714, the disclosures of which are hereby incorporated by reference. These biaxially oriented supports include a paper base and a biaxially oriented polyolefin sheet, typically polypropylene, laminated to one or both sides of the paper base. Transparent supports include cellulose derivatives, e.g., a cellulose ester, cellulose triacetate, cellulose diacetate, cellulose acetate propionate, cellulose acetate butyrate; polyesters, such as poly(ethylene terephthalate), poly(ethylene naphthalate), poly(1,4-cyclohexanedimethylene terephthalate), poly(butylene terephthalate), and copolymers thereof; polyimides; polyamides; polycarbonates; polystyrene; polyolefins, such as polyethylene or polypropylene; polysulfones; polyacrylates; polyetherimides; and mixtures thereof. The kind of paper supports listed above include a wide range of papers, from high end papers, such as photographic paper to low end papers, such as the kind used for newsprint. In a preferred embodiment, commercial offset-grade coated paper is used. The stabilized colloidal silica (and alumina) of this invention are particularly suited for rendering these transparent substrates porous because the small size of the oxide particles are preserved even though high levels of multivalent salts are present. Thus the topcoats coats will provide good image quality and durability, improve the dry time of the ink on the substrate, and maintain the transparency of the system.

The topmost coating composition can also be applied to both sides of the substrate, or alternatively to only one side. The method employed to accomplish this is selected from a number of known techniques, including but not limited to spraying, rod coating, blade coating, gravure coating (direct, reverse, and offset), flexographic coating, size press (puddle and metered), extrusion hopper coating, and curtain-coating. After drying, the resulting topmost layer is calendared to improve gloss.

In one embodiment, in which paper is used as the support, the topmost layer is applied in line as part of the paper manufacturing process. In another embodiment, the topmost layer can also be coated as a separate coating step subsequent to the paper (or other substrate) manufacture. In a particular embodiment, the topmost layer can also be applied inline as part of the inkjet printing operation, wherein such layer is applied to a substrate in a pre-coating station prior to printing of inkjet inks. Such inline application can also be performed by the various coating processes identified above, or alternatively by a printhead positioned inline with the ink-applying printheads. When a printhead is used to apply the coating solution, the option exists of covering only the printed image area with the coating material, rather than the entire area of the substrate. Pre-coat application provides the advantage of eliminating color-to-color bleed during imaging, since the colorants of the ink are fixed instantaneously as the ink contacts the pre-coated substrate. Furthermore, with pre-coating, images appear darker and have sharper edge definition, since the coating reduces ink penetration and permits more fixed colorant on the surface. Finally, while the pre-coat material can optionally be dried completely before image printing, complete drying of the pre-coated substrate is not necessary. Therefore, drying can alternatively be applied once after imaging, resulting in considerable savings in energy.

The topmost layer of the inkjet receiving medium of the invention includes a water-soluble salt of a multivalent metal. Water-soluble is herein defined as at least 0.5 g of the salt capable of dissolving in 100 ml water at 20° C. The salt is preferably essentially colorless and non-reactive. More preferably, the multivalent metal is a cation selected from $Mg^{+2}$, $Ca^{+2}$, $Ba^{+2}$, $Zn^{+2}$, and $Al^{+3}$, most preferably $Ca^{+2}$ or $Mg^{+2}$ in combination with suitable counter ions.

Examples of the salt used in the invention include (but are not limited to) calcium chloride, calcium acetate, calcium nitrate, magnesium chloride, magnesium acetate, magnesium nitrate, barium chloride, barium nitrate, zinc chloride, zinc nitrate, aluminum chloride, aluminum hydroxychloride, and aluminum nitrate. Similar salts will be appreciated by the skilled artisan. Particularly preferred salts are $CaCl_2$, $Ca(CH_3CO_2)_2$, $MgCl_2$, $Mg(CH_3CO_2)_2$, $Ca(NO_3)_2$, or $Mg(NO_3)_2$, including hydrated versions of these salts. Combinations of the salts described above can also be used. The topmost layer preferably includes calcium ion equivalent to at least 30 wt % of calcium chloride, more preferably equivalent to at least 50 wt % of calcium chloride.

Calcium Vs. Magnesium Chloride

Magnesium chloride in the oxide precoats gave very different results than calcium chloride. This was a surprising result because the two salts are generally used interchangeably in the patent literature for inkjet precoats. In precoats that do not contain stabilized oxides, such as those described in US Patent Application 2011/0279554, the two salts are interchangeable in terms of performance. Addition of equal weights of the two anhydrous salts showed a larger improvement in durability in the prints that were precoated with the oxide and the magnesium salt. Both cations are known to destabilize silica in water. Both dispersions were stable when a cationic polymer was first added to the silica to protect the surface. Image quality of prints made from the calcium and magnesium chloride in the oxide dispersions was similar. However the prints with the magnesium chloride precoat withstood Sutherland dry rub testing better than the prints with the calcium chloride precoats. There appears to be a synergy between the oxides in the precoat and the magnesium salt that is not present in the calcium chloride precoats that also contain oxides. This is also evident when comparing the resistance to scratch. Dragging a stylus with a constant load across a printed ink patch removed part of the image from a calcium chloride precoated paper. The same procedure on paper precoated with the oxide-magnesium chloride dispersion did not mar the surface of the same image. Wet durability of the two salts showed the opposite effect where ink patches and print on the calcium salt precoat was less affected by water than when magnesium chloride was present.

Colloidal Stability by Surface Charge Stabilization

While not wanting to be bound by the explanation for why silica is incorporated into high salt precoats using stabilizing polymers. The following explanation is offered for the stability of the coating dispersions. The surface of silica is negatively charged in an aqueous environment. Colloidal particles of silica are stabilized against gellation and precipitation by the negative charge which causes the particles to repel each other in water. The isoelectric point of silica is less than 2, and adding acid to silica dispersions leads to the particles dissolving before the surface is protonated. Thus pure silica will always have a negative electrical surface charge.

The negative charge on colloidal silica particles is associated with counterions of sodium or ammonium groups to balance the charge. These particles are stable for long periods at high pH (8-10), and will stay dispersed for short periods at low pH (3-4) before gellation is observed. Precipitation occurs when the particles approach one another in neutral aqueous media. Aqueous dispersions of pH 5-6 cannot support the charge on silica surface and the particles agglomerate and gel.

The addition of salt will cause the diffuse layer surrounding the silica particle to become more conductive and shrink in size. The positive counter ions are pulled closer to the negative particle surface, lowering the repulsive forces. The particle collisions become more frequent and gellation occurs. The particle dispersion is no longer coatable. Polyvalent cations such as calcium and magnesium are more effective at shrinking the charge layer around the silica than monovalent cations such as sodium or potassium. According to a brochure entitled Properties, Usage, Storage and Handling, Ludox® Colloidal Silica from DuPont Industrial Chemicals Department on page 9, all cations will increase the tendency of the silica to gel, but multivalent cations are more effective gelling agents.

The intentional deposition of colloidal silica particles requires the presence of a potential coagulation agent, typically small concentration of polyvalent metal ions. Monovalent ions such as sodium have similar effects at about 0.3 N concentration in water. In the absence of a flocculating ion in alkaline solutions, a colloidal particle of pure silica bears a negative charge. (The Chemistry of Silica, Solubility, Polymerization, Colloid and Surface Properties, and Biochemistry. Ralph K. Iler, Wiley Interscience, 1979, p. 92) Silica is made to carry a positive charge by coating the surface with an oxide that has a higher isoelectric point. Incorporation of aluminum ions onto the silica surface causes the particles to charge positively. The modified particles are more stable at low pH than the pure silica particles. Dispersions of Ludox® CL and Ludox® CL-P are prepared at pH 4, and are more stable due to the alumina having an isoelectric point between 6 and 8. Unlike silica, alumina is stable below the isoelectric point of the oxide.

In the present invention, stabilization of the silica particles occurs when part of the stabilizing polymer molecule binds tightly to the silica oxide surface while the balance of the polymer extends out into the solution. This polymer coated particle is kept apart from other particles by steric stabilization rather than electrostatic or charge stabilization as the polymer coated particles can stay dispersed in a conductive media that contains a high concentration of multivalent ions. As stated above, the silica with the negative charge was harder to stabilize than the positively charged silica in the presence of the calcium or magnesium chlorides, and the former required higher levels of the sequestering polymers when the salts were present.

The topmost layer of the receiving medium of the invention further includes a cross-linked hydrophilic polymer binder alone or in combination with one or more additional binders. Such hydrophilic polymer binder includes a polymer capable of adsorbing water, and preferably is capable of forming a continuous phase solution. Non-exclusive examples of such materials include gelatin, starch, hydroxycelluloses, polyvinyl alcohol, polyvinyl pyrrolidone, polyethylene imine, polyvinyl amine, and derivatives of these materials. A preferred binder is Gohsefimer Z-320 from Nippon Gohsei, an acetylacetate-modified polyvinyl alcohol.

The water-adsorbing hydrophilic polymer in the topmost layer coating formulation of the invention is crosslinked to improve the print resistance to abrasion while wet, as well as provide increased cohesiveness of the coating upon drying. To provide desired abrasion resistance and cohesiveness, the topmost layer includes at least 5 wt % of crosslinked hydrophilic polymer binder. The identity and amount of crosslinker will depend on the choice of polymer and its reactivity with the crosslinker, the number of crosslinking sites available, compatibility with other solution components, and manufacturing constraints such as solution pot life and coating drying speed. Non-exclusive examples of crosslinker materials are glyoxal, Cartabond TSI (Clariant), Cartabond EPI (Clariant), Sequarez 755 (Omnova), glutaraldehyde sodium bisulfate complex (Aldrich), Sunrez 700M (Omnova), Sunrez 700C (Omnova), CR-5L (Esprix), bis(vinyl) sulfone, bis(vinyl) sulfone methyl ether, adipoyl dihydrazide, epichlorohydrin polyamide resins and urea-formaldehyde resins. In a particular embodiment, the cross-linked hydrophilic polymer includes a cross-linked aceto-acetylated polyvinyl alcohol polymer, such as aceto-acetylated polyvinyl alcohol polymer cross-linked with a glyoxal (Sequarez) or azetidinium ring (Polycup) compounds. The later are cationic polymers made by the reaction of an aliphatic polyamide and epichlorohydrin.

In accordance with the invention, the topmost layer is coated on the substrate at solid content of from 0.3 to 2.5 $g/m^2$, preferably from 0.4 to 2 $g/m^2$, more preferably from 0.4 to 1.5 $g/m^2$, and most preferably from 0.4 to 1.1 $g/m^2$, and such layer includes from 30-70 wt % of one or more aqueous soluble salts of multivalent metal cations. Such combination of relatively low total solid laydown and relatively high multivalent metal salt concentration in a topmost coating composition, along with use of a cross-linked hydrophilic binder and silica with the polymeric stabilizer, has been found to surprisingly enable improved inkjet printing performance when printing pigment-based aqueous inks on a variety of substrates, including coated offset papers as discussed above.

Another aspect of the invention is directed to a method of printing in which the above-described receiver is printed with an inkjet printer employing at least one pigment-based colorant in an aqueous ink composition. Preferably, the pigment-based colorants are stabilized using anionic dispersants. Such dispersants can be polymeric, containing repeating sub-units, or can be monomeric in nature. The present invention is particularly advantageous for printing periodicals, newspapers, magazines, and the like. The printing method can employ a continuous high-speed commercial inkjet printer, for example, in which the printer applies colored images from at least two different print heads, preferably full-width printheads with respect to the media, in sequence in which the different colored parts of the images are registered.

One type of printing technology, commonly referred to as "continuous stream" or "continuous" inkjet printing, uses a pressurized ink source that produces a continuous stream of ink droplets. Conventional continuous inkjet printers use electrostatic charging devices that are placed close to the point where a filament of working fluid breaks into individual ink droplets. The ink droplets are electrically charged and then directed to an appropriate location by deflection electrodes having a large potential difference. When no print is desired, the ink droplets are deflected into an ink-capturing mechanism (catcher, interceptor, gutter,) and either recycled or disposed of. When print is desired, the ink droplets are not deflected and permitted to strike a print medium. Alternatively, deflected ink droplets are permitted to strike the print media, while non-deflected ink droplets are collected in the ink capturing mechanism.

Typically, continuous inkjet printing devices are faster than droplet on demand devices and produce higher quality printed images and graphics. However, each color printed requires an individual droplet formation, deflection, and capturing system. Such continuous inkjet printing devices employ a high-speed inkjet receiving medium transport system capable of transporting at least one of roll-fed or sheet fed receiving medium, in combination with a continuous inkjet printhead for image-wise printing of inkjet ink onto the receiving medium and a drying station for drying of the printed image. Use of a topmost layer in accordance with the present invention in such a high speed continuous inkjet printing device advantageously enables an aqueous pigment-based printed inkjet image to be initially stabilized upon the surface of the receiving medium until the printed image is dried in the device drying station to result in improved image quality, especially when printing on substrates comprising relatively hydrophobic coated offset papers or aqueous ink impermeable plastic films.

Examples of conventional continuous inkjet printers include U.S. Pat. No. 1,941,001 issued to Hansell on Dec. 26, 1933; U.S. Pat. No. 3,373,437 issued to Sweet et al. on Mar. 12, 1968; U.S. Pat. No. 3,416,153 issued to Hertz et al. on Oct. 6, 1963; U.S. Pat. No. 3,878,519 issued to Eaton on Apr. 15, 1975; and U.S. Pat. No. 4,346,387 issued to Hertz on Aug. 24, 1982.

A more recent development in continuous stream inkjet printing technology is disclosed in U.S. Pat. No. 6,554,410 to Jeanmaire, et al. The apparatus includes an ink-drop-forming mechanism operable to selectively create a stream of ink droplets having a plurality of volumes. Additionally, a droplet deflector having a gas source is positioned at an angle with respect to the stream of ink droplets and is operable to interact with the stream of droplets in order to separate droplets having one volume from ink droplets having other volumes. One stream of ink droplets is directed to strike a print medium and the other is directed to an ink catcher mechanism.

The colorant systems of the inkjet ink compositions employed in accordance with one embodiment of the invention can be dye-based, pigment-based or combinations of dye and pigment. Compositions incorporating pigment are particularly useful. Pigment-based ink compositions are used because such inks render printed images having higher optical densities and better resistance to light and ozone as compared to printed images made from other types of colorants. A wide variety of organic and inorganic pigments, alone or in combination with additional pigments or dyes, can be in the present invention. Pigments that can be used in the invention include those disclosed in, for example, U.S. Pat. No. 5,026,427; U.S. Pat. No. 5,086,698; U.S. Pat. No. 5,141,556; U.S. Pat. No. 5,160,370; and U.S. Pat. No. 5,169,436. The exact choice of pigments will depend upon the specific application and performance requirements such as color reproduction and image stability.

Pigments suitable for use in the invention include, but are not limited to, azo pigments, monoazo pigments, di-azo pigments, azo pigment lakes, β-Naphthol pigments, Naphthol AS pigments, benzimidazolone pigments, di-azo condensation pigments, metal complex pigments, isoindolinone and isoindoline pigments, polycyclic pigments, phthalocyanine pigments, quinacridone pigments, perylene and perinone pigments, thioindigo pigments, anthrapyrimidone pigments, flavanthrone pigments, anthanthrone pigments, dioxazine pigments, triarylcarbonium pigments, quinophthalone pigments, diketopyrrolo pyrrole pigments, titanium oxide, iron oxide, and carbon black. In accordance with one embodiment of the invention, colorants comprising cyan, magenta, or yellow pigments are specifically employed. The pigment particles useful in the invention can have any particle sizes which are jetted through a print head. Preferably, the pigment particles have a mean particle size of less than about 0.5 micron, more preferably less than about 0.2 micron.

Self-dispersing pigments that are dispersible without the use of a dispersant or surfactant can be used in the invention. Pigments of this type are those that have been subjected to a surface treatment such as oxidation/reduction, acid/base treatment, or functionalization through coupling chemistry. The surface treatment can render the surface of the pigment with anionic, cationic or non-ionic groups such that a separate dispersant is not necessary. The preparation and use of covalently functionalized self-dispersed pigments suitable for inkjet printing are reported in U.S. Pat. No. 6,758,891, U.S. Pat. No. 6,660,075, U.S. Pat. No. 5,554,739, U.S. Pat. No. 5,707,432, U.S. Pat. No. 5,803,959, U.S. Pat. No. 5,922,118, U.S. Pat. No. 5,837,045, U.S. Pat. No. 6,494,943, U.S. Pat. No. 6,280,513, U.S. Pat. No. 6,503,31, U.S. Pat. No. 6,488,753 and U.S. Pat. No. 6,852,156 and in published applications WO 96/18695, WO 96/18696, WO 96/18689, WO 99/51690, WO 00/05313, and WO 01/51566, U.S. Pat. No. 6,506,239 1, and in EP 1,479,732 A1.

Pigment-based ink compositions employing non-self-dispersed pigments that are useful in the invention can be prepared by any method known in the art of inkjet printing. Dispersants suitable for use in the invention in preparing stable pigment dispersions include, but are not limited to, those commonly used in the art of inkjet printing. For aqueous pigment-based ink compositions, particularly useful dispersants include anionic surfactants such as sodium dodecylsulfate, or potassium or sodium oleylmethyltaurate as described in, for example, U.S. Pat. No. 5,679,138, U.S. Pat. No. 5,651,813 or U.S. Pat. No. 5,985,017.

Polymeric dispersants are also known and useful in aqueous pigment-based ink compositions. Polymeric dispersants include polymers such as homopolymers and copolymers; anionic, cationic or nonionic polymers; or random, block, branched or graft polymers. The copolymers are designed to act as dispersants for the pigment by virtue of the arrangement and proportions of hydrophobic and hydrophilic monomers. The pigment particles are colloidally stabilized by the dispersant and are referred to as a polymer-dispersed pigment dispersion. Polymer stabilized pigment dispersions have the additional advantage of offering image durability once the inks are dried down on the ink receiver substrate.

Preferred copolymer dispersants are those where the hydrophilic monomer is selected from carboxylated monomers. Preferred polymeric dispersants are copolymers prepared from at least one hydrophilic monomer that is an acrylic acid or methacrylic acid monomer, or combinations thereof. Preferably, the hydrophilic monomer is methacrylic acid. Particularly useful polymeric pigment dispersants are further described in US 2006/0012654 A1 and US 2007/0043144 A1, the disclosures of which are incorporated herein by reference.

Inkjet inks printed onto inkjet receiving media in accordance with the invention can contain further addendum as is conventional in the inkjet printing art. Polymeric dispersed pigment-based aqueous inkjet ink formulations suitable for use in particular embodiments of the present invention include those described, e.g., in, commonly assigned U.S. Pat. Nos. 8,398,191, and 8,173,215, and, US Patent Publications 2011/0123714 and 2010/0302292 the disclosures of which are incorporated by reference herein in their entireties.

Advantages

The addition of oxides to precoats for inkjet printing have the following advantages.

The durability of the print is increased. This includes wet abrasion, dry abrasion, and scratch resistance. This is believed to be a consequence of the improved mechanical properties of the precoat due to the addition of the oxide nanoparticles that are added to the binder. These particles act as nanofillers and result in the improved properties. This is true even for thicker precoats, those greater than 1 g/m2 where the properties of most precoats fall off in effectiveness.

The appearance of the paper does not change when the precoat is place on it. The small oxide particles in the precoat do not scatter light and the coating are clear. The gloss of the paper is not greatly affected due to the very small size (10-50 nanometers) of the colloidal silica.

The need for matte particles in the coating is alleviated due to the decreased tendency of the filled precoat layers to stick to one another, either in a paper roll or in a stack of prints. Matte particles are generally large, greater than a mircon, and tend to settle out of the coating dispersions. It is very difficult to maintain dispersion with such large particles that do not carry charge.

Image quality of the prints is very good due to the high concentration of divalent metal salts in the precoated layers that crash out the ink pigment near the surface of the coating. This results in high density, low grain, and low mottle.

Porous layers are formed when the oxide to binder ratio becomes high enough. This permits rapid drying of the inkjet prints which is essential for sheeting and finishing of the paper as is comes off the printing press.

Magnesium chloride provides special increases in durability. There appears to be a synergism between the oxide and the magnesium dication that results in improved durability of the print.

The need for surfactants and antifoam agents is reduced due to the presence of the dispersed oxide. The silica acts as a coating aid for the wetting of the paper substrate. Surfactants and lubricants are added but they are not necessary to achieve coating quality.

EXAMPLES

Print non-uniformity, hereinafter "mottle," is defined as a visually apparent variation in observed color density in a print area intended to be uniform. Coalescence is the unwanted physical merging of non-adsorbed ink drops at the receiver surface. In severe cases, this causes a highly mottled, or extremely non-uniform color distribution that is readily noticed in larger printed areas. In cases of less severe coalescence, the defect takes on the character of fine "grainy" non-uniformity. For purposes of evaluation of the present experimental results, all non-uniformities, regardless of their source or relative size, were combined in the evaluation.

Materials

Gohsefimer Z-320 from Nippon-Gohsei is a poly(vinyl alcohol) substituted with acetylacetate groups to act as crosslinking sites.

Celvol 203 is a poly(vinyl alcohol) from Celanese. Poval R-1130 from Kuraray is a poly(vinyl alcohol) substituted with silanol groups.

Elvanol® 52-22 from DuPont is partially hydrolyzed poly(vinyl alcohol).

Printrite® DP376 from Lubrizol is a water soluble polyurethane.

Poly(ethylenimine) from Sigma-Aldrich was a 50 wt % aqueous solution with Mn 60,000.

Polycup 172 from Ashland is a polyamide-epichlorohydrin resin that contains a reactive 4 membered azetidinium ring, 12 wt % in water.

Sequarez 755 F450 from Omnova is a glyoxyl based crosslinker.

Ludox® CL from Grace is a colloidal silica, positively charged particles that are 12 nanometers in diameter, 30 wt % in water.

Ludox® CL-P from Grace is a colloidal silica, positively charged particles that are 22 nanometers in diameter, 40 wt % in water.

Ludox® AS from Grace is a colloidal silica, negatively charged particles that are 12 nanometers in diameter, 30 wt % in water.

SYLOJET® C30F from Grace is a cationic silica designed for use in inkjet coatings.

Dispal® 18N4-80 from Sasol North America, Inc. in Houston, Tex. is a powder of boehmite alumina.

Polymin® SK from BASF is a water soluble, high molecular weight polyethylenimine, 25 wt % in water.

HM Polymin® from BASF is a water soluble, ultra high molecular weight polyethylenimine, 15 wt % in water.

Catiofast® 159(A) from BASF is a polyamine solution polymer with a quaternized backbone nitrogen atom, 50 wt % in water.

Poly(DADMAC) from Aldrich is poly(diallyldimethylammonium chloride), 20 wt % in water with molecular weight 100,000-200,000.

Poly(AADAD) from Aldrich is poly(acrylamide-co-diallyldimethylammonium chloride), 10 wt % in water.

Lanco 1796 from Lubrizol is a poly(tetrafluoroethylene) bead of approximately 6 microns.

Dynol™ 604 from Air Products is a non-ionic surfactant.

Calcium chloride from OxyChem is anhydrous.

Magnesium chloride from Sigma-Aldrich is the dihydrate, $MgCl_2$.

General Procedure for Preparation of Dispersions and Coating onto Paper

Polyvinylalcohol solutions were prepared at 10 wt % solids. Silica dispersions were obtained from Grace Davison as 30 or 40 wt % dispersions in water. Ludox® CL and CL-P were used as received but Ludox®AS was adjusted to pH 4 using 1 N HCl. Alumina was obtained from Sasol as Dispal® 18N4-80 powder and added to water with stirring to make an acidic dispersion. The polymers used to sequester the silica, such as Polymin® SK, were acidified with 1N HCl, except for PEI homopolymer, which was acidified with concentrated HCl. Polytetrafluoroethylene beads Lanco were added with vigorous stirring to a 1 wt % Dyanol™ 604 non-ionic surfactant water dispersion to give a 10 wt % final dispersion.

A general procedure for the formulations is as follows. The pH of all components was adjusted with acid to approximately 4, typically with HCl. The oxide should be treated with the stabilizing polymer before being exposed to the multivalent salt. The stabilizing polymer was diluted with excess water, the oxide added, and the solution stirred for two hours. The binder polymer, generally PVA, was added slowly to the stirred solution. A previously prepared 40 wt % solution of $CaCl_2$ was then slowly added to the stirred polymer-oxide dispersion. Lubricants such as Silwet L7602, or previously prepared dispersions of tetrafluoroethylene beads stabilized with a surfactant were added at the end of the coating dispersion preparation following by the cross-linker. The aqueous dispersions were 15 wt % solids.

The preferred method to apply the solutions to paper substrates was the Tabletop Mini-Labo™ coater, which employs the "Micro Gravure™" Coating Method, Yasui Seiki Co., (USA) Bloomington, Ind., www.yasui.com or www.mirwecfilm.com. A 150R Micro Gravure™ roller produced approximately a 1.1 g/m$^2$ coating on SUG using the 15 wt % precoat dispersions, and the 250R roller 0.6 g/m$^2$. The paper speed was 2.50 m/min and the gravure roller speed 33 RPM to give a speed ratio of 0.83 for the 15 wt % coating dispersions. Alternatively an extrusion hopper coater was used to coat films of approximately 1.5, 1.0, and 0.5 g/m$^2$ onto the paper supports using a 5 wt % coating solution.

Samples of the coatings were printed with KODAK PROSPER polymeric dispersant dispersed pigment-based cyan and black aqueous inkjet inks in separate patterns of uniform patches of density varying from minimum to maximum using a continuous inkjet printer test bed. The prints were permitted to dry for 3 days at ambient conditions. Dry rub resistance was tested using a Sutherland rub tester to abrade a black patch at maximum ink laydown (Dmax) for 10 cycles at 4 kg using bond paper as the abrasive. Wet abrasion was tested by applying ~0.2 ml water to a printed black Dmax patch for 20 seconds before rubbing for 5 back-and-forth cycles with double layer of paper toweling weighted with a 100 g brass weight (24 mm diameter). The change in density of the tested print regions was measured using a Spectrolino densitometer (status T visual) as an indication of the print durability to these tests. On the same paper sample, cyan prints were made of a stepped density target, including 10 uniform patches from 10% to 100% ink fill in 10% increments. These print samples were characterized for print uniformity (grain-mottle) using a QEA PIASII handheld image analyzer. The density of maximum cyan ink levels was measured (status T densitometry with a 2 degree observer). Mottle of each step patch was measured in terms of CIE L* using a 412 um tile size per the procedure described in ISO13660 and summed over all 10 density patches. Alternatively, the maximum L* mottle value measured was recorded.

Two coated papers were used as the substrate for precoat treatment: Sterling® Ultra Gloss (SUG) from NewPage and Utopia Book 45 pound (UB45) paper from Appleton Coated. These same manufacturers offer similar papers that have been optimized for inkjet printing (NewPage TrueJet® and Appleton Coating Utopia Book IJ). These commercial inkjet papers were also printed (without pretreatment) and tested.

Example 1

Demonstration of the Concept of Silica in Precoats

The first part of this work describes the combination of Si particles, a protonated amine-containing polymer, and a divalent metal salt such as $CaCl_2$ and claims a benefit of coatability, image quality, and durability. Starting position was based on a recommended formulation:

0.75 g/m$^2$ $CaCl_2$
0.11 g/m$^2$ Polymin® SK cationic polymer
0.16 g/m$^2$ Ludox® CL-P colloidal silica
0.11 g/m$^2$ Poval® R-1130 PVA binder
0.016 g/m$^2$ guar gum thickener
0.00065 g/m$^2$ Polycup 172 crosslinker This was coated over NewPage Sterling Ultra gloss 80# offset text paper. Comparative coatings were made by removing $CaCl_2$, Polymin®SK, and Ludox® either singly or in combination with one another. Black Dmax print durability was tested using the Sutherland dry rub test method previously described. A cyan step wedge was measured for density, graininess, and mottle. The maximum grain and mottle values for each coating are in the Table 1.1. Also included are similar tests made on uncoated SUG.

TABLE 1.1

Precoat of $CaCl_2$, Polymin ® SK stabilizer, Ludox ® CL-P silica, PVA

| summary | Dmin 75° gloss | Black Dmax | dry rub % Dmax loss | Max L(CIE) Graininess | Max L(CIE) Mottle |
|---|---|---|---|---|---|
| 1 invention | 59 | 1.81 | 2% | 3.05 | 0.98 |
| 2 CaCl2 | 61.4 | 1.89 | 9% | 4.71 | 4.84 |
| 3 PolyminSK | 44.2 | 1.81 | 29% | 3.61 | 1.00 |
| 4 Ludox | 65.6 | 1.85 | 51% | 3.10 | 0.85 |
| 5 CaCl2, PolyminSK | 55.2 | 2.14 | 3% | 4.49 | 4.45 |
| 6 CaCl2, Ludox | 64 | 1.61 | 3% | 3.68 | 3.86 |
| 7 PolyminSK, Ludox | 65.9 | 1.84 | 43% | 3.08 | 0.87 |
| 8 CaCl2, PolyminSK, Ludox | 63.6 | 1.63 | 0% | 4.87 | 3.88 |
| untreated SUG | 65 | 1.64 | 0% | 3.93 | 4.09 |

First note that in the absence of Polymin® SK, the remaining combination of $CaCl_2$ and Ludox® results in a coating with an undesirably reduced gloss, probably due to agglomeration of the Si particles. Removal of $CaCl_2$ results in drastically poorer print quality (increased grain and mottle in parts 2, 5, 6, 8). The removal of Ludox® from coatings containing Ca causes the prints to be much more susceptible to Dmax loss upon dry rub (1 vs 4, 3 vs 7). The only coating that demonstrates a combined performance of good dry rub resistance, good print IQ, and high gloss is the invention precoat with the silica, PolyminSK stabilizer polymer, and $CaCl_2$.

Example 2

Table 2.1 below details the composition of a precoat that contains silica at about 14 wt % of the total solids. The PEI containing copolymer Polymin® SK was necessary as a stabilizer at about 4.5 wt Z320 PVAacac was used as the crosslinkable binder and Polycup 172 was the crosslinking agent at about 4.5 wt %. Alternatively, half of the Z320 PVAacac was replaced with Elvanol® 52-22PVA. One of two Silwet siloxane-PEO block copolymers was added to act as a lubricant and an antifoam agent in all coating solutions except E. Additionally coating solutions E-G contained Lanco polytetrafluoroethylene beads dispersed with a surfactant. The coating solutions were prepared at 15 wt % total solids in water and coated onto either Sterling® UltraGloss (SUG) or Utopia Book 45 pound paper. Comparative examples were prepared using Sterling TrueJet® or Utopia Book Ink Jet (UBIJ) receiver. The samples were coated using a Mini-Labo™ tabletop Micro Gravure™ coater. Prints were made with continuous inkjet using Kodak Stream inks.

TABLE 2.1

Formulations of Example 2. Final solids content was 15 wt % in water. Weight fraction is of the final solids of the dispersion.

| component | CaCl2 | Polycup 172 | Polymin SK | Z-320 | Elvanol52-22 | Ludox CL-P | Silwet L-7602 | Silwet L-7604 | Lanco PTFE | total wt reag |
|---|---|---|---|---|---|---|---|---|---|---|
| A wt fract | 0.563 | 0.047 | 0.047 | 0.188 | 0.000 | 0.141 | 0.014 | 0.000 | 0.000 | 1.000 |
| B wt fract | 0.563 | 0.047 | 0.047 | 0.188 | 0.000 | 0.141 | 0.000 | 0.014 | 0.000 | 1.000 |
| C wt Tract | 0.563 | 0.047 | 0.047 | 0.094 | 0.094 | 0.141 | 0.014 | 0.000 | 0.000 | 1.000 |
| D wt fract | 0.563 | 0.047 | 0.047 | 0.094 | 0.094 | 0.141 | 0.000 | 0.014 | 0.000 | 1.000 |
| E wt fract | 0.545 | 0.045 | 0.045 | 0.182 | 0.000 | 0.136 | 0.000 | 0.000 | 0.045 | 1.000 |
| F wt fract | 0.538 | 0.045 | 0.045 | 0.179 | 0.000 | 0.135 | 0.013 | 0.000 | 0.045 | 1.000 |
| G wt fract | 0.538 | 0.045 | 0.045 | 0.179 | 0.000 | 0.135 | 0.000 | 0.013 | 0.045 | 1.000 |

The image quality for the prints is summarized in Table 2.2. The prints incorporating the silica were superior to the controls for image quality. The first 7 samples were printed on silica containing precoats of approximately 1.1 grams per square meter (g/m$^2$) and the second 7 samples on silica containing precoats of 0.6 g/m$^2$. The cyan density was higher than the TrueJet® control in all cases. Grain and mottle were also improved (lower values) compared to the TrueJet® control.

The third set of 7 samples was printed on UB45 coated with 0.6 g/m2. Comparison to the UBIJ control showed the precoated silica samples had higher density and lower grain to produce higher quality images. Sample 19 was the one sample where the mottle was significantly higher, Max L(CIE) 1.4 and Sum L(CIE) 8.1, as compared to the control at 1.0 and 6.3, respectively. This could have been caused by a coating or substrate defect.

TABLE 2.2

Image Quality of Example 2

| Substrate | Print Sample | Ctg Soln | Precoat Thickness (gsm) | Max Cyan Density Mean | Max L(CIE) Graininess | SumL(CIE) Graininess | Max L(CIE) Mottle | Sum L(CIE) Mottle |
|---|---|---|---|---|---|---|---|---|
| SUG | 1 | A | 1.1 | 1.79 | 3.0 | 20.0 | 0.6 | 5.0 |
| SUG | 2 | B | 1.1 | 1.75 | 3.1 | 21.7 | 0.6 | 4.8 |
| SUG | 3 | C | 1.1 | 1.75 | 2.9 | 20.7 | 0.6 | 5.2 |
| SUG | 4 | D | 1.1 | 1.81 | 3.0 | 21.4 | 0.6 | 4.9 |
| SUG | 5 | E | 1.1 | 1.73 | 2.9 | 21.4 | 0.6 | 5.1 |
| SUG | 6 | F | 1.1 | 1.74 | 3.1 | 22.1 | 0.8 | 5.4 |
| SUG | 7 | G | 1.1 | 1.74 | 3.1 | 21.6 | 0.7 | 5.4 |
| TrueJet | 8 | | 1.1 | 1.64 | 3.8 | 25.5 | 0.8 | 6.2 |
| SUG | 9 | A | 0.6 | 1.81 | 3.3 | 23.0 | 0.7 | 5.1 |
| SUG | 10 | B | 0.6 | 1.79 | 3.3 | 22.8 | 0.7 | 5.5 |
| SUG | 11 | C | 0.6 | 1.80 | 3.5 | 23.7 | 0.7 | 5.0 |
| SUG | 12 | D | 0.6 | 1.81 | 3.3 | 22.7 | 0.6 | 5.4 |
| SUG | 13 | E | 0.6 | 1.78 | 3.6 | 23.4 | 0.7 | 5.3 |
| SUG | 14 | F | 0.6 | 1.78 | 3.5 | 23.3 | 0.7 | 5.3 |
| SUG | 15 | G | 0.6 | 1.78 | 3.3 | 22.8 | 0.7 | 5.5 |
| TrueJet | 16 | | 0.6 | 1.64 | 3.8 | 25.5 | 0.8 | 6.2 |
| UB45 | 17 | A | 0.6 | 1.52 | 3.4 | 23.4 | 0.9 | 6.9 |
| UB45 | 18 | B | 0.6 | 1.51 | 3.2 | 23.9 | 0.8 | 6.5 |
| UB45 | 19 | C | 0.6 | 1.45 | 3.2 | 24.3 | 1.4 | 8.1 |
| UB45 | 20 | D | 0.6 | 1.51 | 2.9 | 22.7 | 0.8 | 6.1 |
| UB45 | 21 | E | 0.6 | 1.49 | 3.1 | 23.3 | 0.8 | 6.2 |
| UB45 | 22 | F | 0.6 | 1.48 | 3.2 | 23.8 | 0.9 | 6.4 |
| UB45 | 23 | G | 0.6 | 1.52 | 3.1 | 23.4 | 0.7 | 5.9 |
| UBIJ | 24 | | 0.6 | 1.41 | 3.8 | 26.9 | 1.0 | 6.3 |

gsm is grams per square meter

Table 2.3 shows the dry and wet durability of the prints in Example 2. The Sutherland dry rub for the samples was very effective, the highest value being only a 5% density loss for Print 1. The density transfer from the black patch (dmax) to the white paper (dmin) was also good for the samples, with the highest being the control UBIJ at 0.013. It is significant that the samples that did not have the Lanco PTFE particles but still showed good dry rub. This may be due to the higher modulus of the silica filled PVA that makes the coating more resistant to wear, as well as the Silwet lubricants in the coating. Coatings without large wax particles that produce good properties in the prints are desirable because wax particles settle out from the coating dispersion with time, making long coating runs difficult because the coating dispersions are not stable. The desired level of wax particles necessary to protect the surface of the print can be difficult to control and ensure consistent delivery of particles throughout the coating. Additionally storage of the coating fluid is more difficult if the wax particles settle from the coating solution and require redispersion. In this Example, coating solutions A-D that did not contain the Lanco PTFE particles were more stable than the samples E-G that contained Lanco particles which settled out on standing for several days.

Wet abrasion of the silica samples was generally effective, particularly for the thin precoats on SUG, Coating 9-15. Of these the two samples that contained lower levels of crosslinkable Z320 PVA-acac and equal levels of the non-functionalized Elvanol® 52-22 PVA (Coatings 11 and 12) showed slightly elevated density loss inside the water drop (8%), although little density changed outside the water drop or transferred to the dmin areas. The factor that stands out is that the wet durability of the silica containing precoats is much better than either of the controls. Prints made on TrueJet® paper displayed a density loss of 73% inside the water drop and 82% outside the water drop, with a density transfer to dmin of 0.21. In comparison, the highest density transfer to dmin on any of the silica precoats was 0.02. Similarly, prints made on UBIJ displayed a density loss of 47% inside the water drop and 39% outside the water drop, with a density transfer to dmin of 0.06. In comparison, the highest density transfer to dmin on any of the silica precoats on UB45 was 0.04.

TABLE 2.3

Durability of Example 2

| | | 4 Color Printer | | Dry rub durability tested ~ 3 hr after printing. Wet rub testing after 40 C/50% RH for 20 hr | | | | |
|---|---|---|---|---|---|---|---|---|
| | | | | | dry rub | wet abrasion in drop | wet abrasion outside of drop | wet abrasion |
| | Substrate | Dry Laydown (gsm) | Black Dmax | dry rub density loss | Density transfer to Dmin | density loss in water drop | density loss outside water drop | Density transferred to Dmin |
| 1 | SUG | 1.1 | 1.64 | −5% | 0.000 | 12% | −2% | 0.00 |
| 2 | SUG | 1.1 | 1.62 | −3% | 0.000 | 4% | 0% | 0.01 |
| 3 | SUG | 1.1 | 1.63 | −2% | 0.007 | 28% | 4% | 0.01 |
| 4 | SUG | 1.1 | 1.63 | −4% | 0.002 | 15% | 0% | 0.01 |
| 5 | SUG | 1.1 | 1.61 | −2% | 0.000 | −1% | −3% | 0.00 |
| 6 | SUG | 1.1 | 1.65 | −2% | 0.000 | 3% | −2% | 0.00 |
| 7 | SUG | 1.1 | 1.65 | −1% | 0.000 | 15% | 5% | 0.02 |
| 8 | TrueJet | | 1.81 | 0% | 0.007 | 73% | 82% | 0.21 |
| 9 | SUG | 0.6 | 1.94 | −1% | 0.000 | 3% | −3% | 0.02 |
| 10 | SUG | 0.6 | 1.89 | −3% | 0.010 | 2% | −4% | 0.02 |
| 11 | SUG | 0.6 | 1.91 | 2% | 0.000 | 8% | −2% | 0.01 |
| 12 | SUG | 0.6 | 1.91 | −2% | 0.003 | 8% | −1% | 0.02 |
| 13 | SUG | 0.6 | 1.87 | −3% | 0.000 | −3% | −7% | 0.01 |
| 14 | SUG | 0.6 | 1.91 | 1% | 0.003 | −3% | −7% | 0.02 |
| 15 | SUG | 0.6 | 1.90 | −1% | 0.010 | 0% | −4% | 0.02 |
| 16 | TrueJet | | 1.81 | 0% | 0.007 | 73% | 82% | 0.21 |
| 17 | UB45 | 0.6 | 1.53 | 2% | 0.013 | 23% | 11% | 0.04 |
| 18 | UB45 | 0.6 | 1.47 | 1% | 0.013 | 17% | 7% | 0.02 |
| 19 | UB45 | 0.6 | 1.36 | −6% | 0.010 | −4% | −6% | 0.00 |
| 20 | UB45 | 0.6 | 1.47 | 0% | 0.007 | 19% | 8% | 0.01 |
| 21 | UB45 | 0.6 | 1.48 | −1% | 0.010 | 12% | 9% | 0.04 |
| 22 | UB45 | 0.6 | 1.50 | 4% | 0.003 | 10% | 5% | 0.03 |
| 23 | UB45 | 0.6 | 1.49 | 0% | 0.003 | 9% | 2% | 0.02 |
| 24 | UBIJ | | 1.39 | 2% | 0.013 | 47% | 39% | 0.06 |

Example 3

Increasing Levels of Silica for Ink Absorption (Porosity)

Increasing levels of silica were formulated to produce coatings that contained 18, 30, and 39 wt % coatings. Polymin® SK was used to stabilize the silica in the calcium chloride solutions at approximately 7 wt % of the solids. The calcium chloride content decreased as the silica content increased at 63, 52, and 46 wt %, respectively.

Precoat dispersions were prepared with three levels of silica in a crosslinkable PVA binder (Table 3.1). Three levels of crosslinker were used for each silica levels to give 9 coating formulations. The dispersions were 15 wt % solid in water. All dispersions contained the same level of Lanco polytetrafluoroethylene beads dispersed with a surfactant.

TABLE 3.1

Formulations for Example 3. Final solids content was 15 wt % in water. Weight fraction is of the final solids of the dispersion.

| component | CaCl2 | Polycup | PolyminSK | Z-320 | Elvanol 52-22 | Ludox CL-P | Lanco PTFE | total wt reagents |
|---|---|---|---|---|---|---|---|---|
| A wt fraction | 0.631 | 0.005 | 0.068 | 0.045 | 0.045 | 0.180 | 0.027 | 1.000 |
| B wt fraction | 0.628 | 0.009 | 0.067 | 0.045 | 0.045 | 0.179 | 0.027 | 1.000 |
| C wt fraction | 0.625 | 0.013 | 0.067 | 0.045 | 0.045 | 0.179 | 0.027 | 1.000 |
| D wt fraction | 0.524 | 0.004 | 0.075 | 0.037 | 0.037 | 0.300 | 0.022 | 1.000 |
| E wt fraction | 0.522 | 0.007 | 0.075 | 0.037 | 0.037 | 0.299 | 0.022 | 1.000 |
| F wt fraction | 0.520 | 0.011 | 0.074 | 0.037 | 0.037 | 0.297 | 0.022 | 1.000 |
| G wt fraction | 0.456 | 0.003 | 0.065 | 0.033 | 0.033 | 0.391 | 0.020 | 1.000 |
| H wt fraction | 0.455 | 0.006 | 0.065 | 0.032 | 0.032 | 0.390 | 0.019 | 1.000 |
| I wt fraction | 0.453 | 0.010 | 0.065 | 0.032 | 0.032 | 0.388 | 0.019 | 1.000 |

Coatings of three of the dispersions on SUG were tested for porosity using a Bristow Wheel, a test commonly used in the paper industry. (R. W. Rious, master thesis in ChemEng, U of Maine, 2003). In this test, higher porosity results in shorter traces of ink on paper because of absorption. Coatings of dispersions B, E, and H from Table 3.1 as precoats on SUG at 1.1 g/m$^2$ were tested using a dye based aqueous ink. Table 3.2 shows that increasing the silica content for these coatings results in shorter traces of ink on paper strips coated with the precoats. Increasing levels of silica produces a more porous precoat. Additional experiments (not shown here) have suggested that the absorption change is not linear, but increases abruptly at approximately 25 wt % silica. The silica content quoted is based on the starting formulation which contains approximately 50 wt % salt.

The ratio of silica to binder polymer is much higher in the coating on the paper than the formulation suggest. The salt can migrate into the paper pores as the water is absorbed before drying. This leaves a layer of polymer with the silica on the surface. The polymer to silica ratio based on weight was 3/1 for the highest silica loading. This includes the binder polymer and the Polymin®SK stabilizer in the polymer part of the ratio. The ratios for the three Bristow samples are included in Table 3.2.

TABLE 3.2

Length of Ink Trace vs. Silica Containing Precoats made with Bristow Wheel

| Example 3 | Precoat Silica % | Test 1 (cm) | Test 2 (cm) | trace length Avg (cm) | ratio Silica/Polymer |
|---|---|---|---|---|---|
| | 0 | 26.7 | 25.1 | 25.9 | |
| B | 18 | 24.2 | 22 | 23.1 | 1.1 |
| E | 30 | 18.8 | 17.1 | 17.95 | 2 |
| H | 39 | 16.6 | 14.1 | 15.35 | 3 |
| | SUG | 15.5 | 14 | 14.8 | |

The image quality for the prints is summarized in Table 3.3. The prints incorporating the silica coating that had the higher coat weight of 1.1 g/m$^2$ (1-9) were superior to the controls for image quality. The silica precoats gave higher cyan density than the TrueJet®. Grain and mottle were also improved (lower values) compared to the TrueJet® control (25). The thinner precoats (0.6 g/m$^2$) (10-18) showed better image quality than the control for the lower levels of silica, but the image quality was not as good for the precoats with higher silica. This is probably due to the lower levels of salt in the later samples, which is evident from Table 3.1 and suggest more $CaCl_2$ should be added to the coating formulation. Specifically, the 18 wt % silica formulation contained about 63 wt % divalent salt, the 30 wt % silica formulations contained about 50 wt % salt, and the 39 wt % silica formulation contained about 45 wt % salt. Gloss was lower in the thicker prints on SUG than normally observed in these coatings, probably due to an insufficient level of stabilizer. The thicker coatings averaged 49 and the thinner coatings 61 gloss units @ 75°. Table 3.1 shows the stabilizer was only 25-35 of the weight of the silica, testing the lower limits of the steric stabilization.

The third and forth sets of samples in Table 3.3 were coated from the three center samples based on crosslinker of each of the three silica levels, formulations B, E and H. These were the three formulations which when coated on SUG were evaluated on the Bristow wheel for porosity. They were printed on UB45 and coated at 1.1 g/m$^2$ (19-21) and 0.6 g/m$^2$ (22-24). Comparison to the UBIJ (26) control showed the same general trend for image quality as described for the coating on SUG. The higher coat weight precoats produced good quality images that were superior to the control, while the lower coat weight samples showed decreased image quality at the higher silica levels, probably due to the lower levels of salt present on the paper for printing.

TABLE 3.3

Image quality of Example 3.

| Print/Coating Substrate | Ctg Soln | Precoat Thickness (gsm) | Max Cyan Density Mean | Max L(CIE) Graininess | Sum L(CIE) Graininess | Max L(CIE) Mottle | Sum L(CIE) Mottle |
|---|---|---|---|---|---|---|---|
| 1; SUG | 18% Silica; L-XL | 1.1 | 1.62 | 2.74 | 19.95 | 0.66 | 5.39 |
| 2 SUG | 18% Silica; M-XL | 1.1 | 1.61 | 2.93 | 20.20 | 0.64 | 5.24 |
| 3; SUG | 18% Silica; H-XL | 1.1 | 1.59 | 3.01 | 21.14 | 0.69 | 5.38 |
| 4; SUG | 30% Silica; L-XL | 1.1 | 1.65 | 3.49 | 24.02 | 0.67 | 5.40 |
| 5; SUG | 30% Silica; M-XL | 1.1 | 1.63 | 3.54 | 24.88 | 0.64 | 5.33 |
| 6; SUG | 30% Silica; H-XL | 1.1 | 1.59 | 3.35 | 22.27 | 1.14 | 5.80 |
| 7; SUG | 39% Silica; L-XL | 1.1 | 1.58 | 3.54 | 23.97 | 0.72 | 5.60 |
| 8; SUG | 39% Silica; M-XL | 1.1 | 1.58 | 3.28 | 22.58 | 0.69 | 5.26 |
| 9; SUG | 39% Silica; H-XL | 1.1 | 1.60 | 3.44 | 24.02 | 0.75 | 5.63 |
| 25; TrueJet$^R$ | TrueJet | | 1.42 | 3.89 | 27.50 | 0.94 | 6.95 |
| 10; SUG | 18% Silica; L-XL | 0.6 | 1.62 | 3.28 | 23.07 | 0.75 | 5.70 |
| 11 SUG | 18% Silica; M-XL | 0.6 | 1.63 | 3.56 | 25.08 | 0.78 | 5.71 |
| 12; SUG | 18% Silica; H-XL | 0.6 | 1.61 | 3.50 | 23.50 | 0.75 | 5.67 |
| 13; SUG | 30% Silica; L-XL | 0.6 | 1.61 | 3.78 | 25.41 | 0.84 | 6.05 |
| 14; SUG | 30% Silica; M-XL | 0.6 | 1.60 | 3.74 | 25.82 | 0.94 | 6.47 |
| 15; SUG | 30% Silica; H-XL | 0.6 | 1.61 | 3.76 | 24.74 | 0.84 | 5.98 |
| 16; SUG | 39% Silica; L-XL | 0.6 | 1.61 | 4.03 | 26.34 | 0.95 | 6.72 |
| 17; SUG | 39% Silica; M-XL | 0.6 | 1.59 | 4.15 | 26.25 | 1.00 | 6.90 |
| 18; SUG | 39% Silica; H-XL | 0.6 | 1.60 | 4.20 | 27.95 | 0.92 | 6.53 |
| 25; TrueJet$^R$ | TrueJet | | 1.42 | 3.89 | 27.50 | 0.94 | 6.95 |
| 19; UB45 | 18% Silica; M-XL | 1.1 | 1.41 | 2.81 | 21.04 | 0.80 | 6.18 |
| 20; UB45 | 30% Silica; M-XL | 1.1 | 1.38 | 3.05 | 23.10 | 0.91 | 6.44 |
| 21; UB45 | 39% Silica; M-XL | 1.1 | 1.36 | 3.12 | 22.55 | 0.84 | 6.28 |
| 26; UB-IJ | UB-IJ | | 1.32 | 4.41 | 30.28 | 0.97 | 6,82 |
| 22; UB45 | 18% Silica; M-XL | 0.6 | 1.38 | 3.56 | 26.19 | 0.83 | 6.59 |
| 23; UB45 | 30% Silica; M-XL | 0.6 | 1.41 | 4.20 | 28.35 | 0.93 | 6.60 |
| 24; UB45 | 39% Silica; M-XL | 0.6 | 1.38 | 4.32 | 29.54 | 1.04 | 7.39 |
| 26; UB-IJ | UB-IJ | | 1.32 | 4.41 | 30.28 | 0.97 | 6.82 |

L, M, H-XL is low, medium, high crosslinker at each of the three silica levels gsm is grams per square meter The durability of the precoats in Example 3 is summarized in Table 3.4. The precoats of samples 1-9 in Figure 3.2 were approximately 1.1 g/m$^2$ laydown and samples 10-18 were about half as thick at 0.6 g/m$^2$. The samples had good Sutherland dry rub with little spreading of the black ink. The results were comparable to the dry rub durability of the TrueJet® mill treated ink jet paper. The wet durability of the samples indicated a preference for the thicker samples, and a trend toward better durability with increasing silica. The wet durability of the thinner samples with 0.6 g/m$^2$ precoats was not as effective, although the precoated samples had better wet durability then SUG.

TABLE 3.4

Shows the dry and wet durability of the prints in Example 3

| | | 4 Color Printer | | dry rub density | Wet rub testing after 40C/50% RH for 20 hr | | | |
|---|---|---|---|---|---|---|---|---|
| | Ctg Soln 1PolyminSK 1.5silica | Dry Laydown (gsm) | Black Dmax | of rubbed area | dry rub Density transfer to Dmin | wet abrasion in drop % density loss in water drop | wet abrasion outside of drop % density loss outside water drop | wet abrasion Density transferred to Dmin |
| 1; SUG | 18% Silica; L-XL | 1.1 | 1.76 | 1.77 | 0.000 | 29% | 14% | 0.01 |
| 2 SUG | 18% Silica; M-XL | 1.1 | 1.73 | 1.76 | 0.003 | 37% | 13% | 0.01 |
| 3; SUG | 18% Silica; H-XL | 1.1 | 1.71 | 1.70 | 0.000 | 15% | 11% | 0.01 |
| 4; SUG | 30% Silica; L-XL | 1.1 | 1.85 | 1.87 | 0.007 | 22% | 8% | 0.01 |
| 5; SUG | 30% Silica; M-XL | 1.1 | 1.78 | 1.83 | 0.000 | 15% | 7% | 0.00 |
| 6; SUG | 30% Silica; H-XL | 1.1 | 1.72 | 1.73 | 0.000 | 20% | 17% | 0.00 |
| 7; SUG | 39% Silica; L-XL | 1.1 | 1.76 | 1.80 | 0.007 | 20% | 12% | 0.01 |

TABLE 3.4-continued

Shows the dry and wet durability of the prints in Example 3

| | | 4 Color Printer | | | | Wet rub testing after 40C/50% RH for 20 hr | | |
|---|---|---|---|---|---|---|---|---|
| | Ctg Soln 1PolyminSK 1.5silica | Dry Laydown (gsm) | Black Dmax | dry rub density of rubbed area | dry rub Density transfer to Dmin | wet abrasion in drop % density loss in water drop | wet abrasion outside of drop % density loss outside water drop | wet abrasion Density transferred to Dmin |
| 8; SUG | 39% Silica; M-XL | 1.1 | 1.75 | 1.77 | 0.003 | 14% | 11% | 0.00 |
| 9; SUG | 39% Silica; H-XL | 1.1 | 1.80 | 1.80 | 0.007 | 8% | 4% | 0.01 |
| 10; SUG | 18% Silica; L-XL | 0.6 | 1.91 | 1.96 | 0.000 | 32% | 25% | 0.03 |
| 11 SUG | 18% Silica; M-XL | 0.6 | 1.92 | 1.93 | 0.000 | 28% | 27% | 0.06 |
| 12; SUG | 18% Silica; H-XL | 0.6 | 1.90 | 1.94 | 0.000 | 35% | 23% | 0.02 |
| 13; SUG | 30% Silica; L-XL | 0.6 | 1.91 | 1.95 | 0.007 | 40% | 29% | 0.05 |
| 14; SUG | 30% Silica; M-XL | 0.6 | 1.89 | 1.91 | 0.000 | 34% | 27% | 0.04 |
| 15; SUG | 30% Silica; H-XL | 0.6 | 1.89 | 1.95 | 0.000 | 37% | 15% | 0.03 |
| 16; SUG | 39% Silica; L-XL | 0.6 | 1.87 | 1.88 | 0.003 | 38% | 30% | 0.06 |
| 17; SUG | 39% Silica; M-XL | 0.6 | 1.84 | 1.87 | 0.000 | 43% | 34% | 0.06 |
| 18; SUG | 39% Silica; H-XL | 0.6 | 1.85 | 1.89 | 0.010 | 29% | 24% | 0.05 |
| 25 | TrueJet | | 1.60 | 1.60 | 0.007 | 58% | 68% | 0.21 |
| 19; UB45 | 18% Silica; L-XL | 0.6 | 1.42 | 1.41 | 0.000 | 13% | 9% | 0.01 |
| 20; UB45 | 30% Silica; M-XL | 0.6 | 1.43 | 1.42 | 0.000 | 11% | 7% | 0.06 |
| 21; UB45 | 39% Silica; H-XL | 0.6 | 1.45 | 1.41 | 0.000 | 20% | 10% | 0.01 |
| 22; UB45 | 18% Silica; L-XL | 0.6 | 1.47 | 1.45 | 0.007 | 40% | 21% | 0.03 |
| 23; UB45 | 30% Silica; M-XL | 0.6 | 1.47 | 1.44 | 0.003 | 27% | 19% | 0.03 |
| 24; UB45 | 39% Silica; H-XL | 0.6 | 1.45 | 1.41 | 0.000 | 29% | 18% | 0.04 |

gsm is grams per square meter

Example 4

Stabilizing Polymers for Silica in High Salt Solutions

Five amino containing polymers were used as the stabilizer for cationic silica. The silica made up 10 wt % of the total solids and the stabilizer was approximately 8 wt %. The calcium chloride was about 70 wt % of the dry precoat, and the PVA binder was 10 wt %. These cationic polymers stabilized the silica against flocculation by the calcium salt. Xanthan gum (Ticaxan Xanthan EC) was added to increase viscosity for coating and this caused settling over several days. The formulations were readily redispersed by gentle shaking. The formulations produced good image quality when printed with a four color ink jet printer. The binder polymer Kurray Poval® R-1130 PVA and the silica Ludox® CL-P each made up about 10 percent of the weight of the coating. The stabilizer polymer was at 7.7 wt % of the precoat. The coating dispersions were prepared as shown Table 4.1 and coated at two levels of coat weight. The dispersions were acidified to pH 4 with HCl. No crosslinking agent was used in the formulation.

TABLE 4.1

Formulations of Example 4. Final solids content was 15 wt % in water. Weight fraction is of the final solids of the dispersion.

| component | CaCl2 | PolyminSK | Catiofast | DADMAC | AADAD | HM Polymin | R-1130 | Ludox CL-P | total wt reagent |
|---|---|---|---|---|---|---|---|---|---|
| A wt fraction | 0.718 | 0.077 | 0.000 | 0.000 | 0.000 | 0.000 | 0.103 | 0.103 | 1.000 |
| B wt fract | 0.718 | 0.000 | 0.077 | 0.000 | 0.000 | 0.000 | 0.103 | 0.103 | 1.000 |
| C wt fract | 0.718 | 0.000 | 0.000 | 0.077 | 0.000 | 0.000 | 0.103 | 0.103 | 1.000 |
| D wt fract | 0.718 | 0.000 | 0.000 | 0.000 | 0.077 | 0.000 | 0.103 | 0.103 | 1.000 |

TABLE 4.1-continued

Formulations of Example 4. Final solids content was 15 wt % in water. Weight fraction is of the final solids of the dispersion.

| component | CaCl2 | PolyminSK | Catiofast | DADMAC | AADAD | HM Polymin | R-1130 | Ludox CL-P | total wt reagent |
|---|---|---|---|---|---|---|---|---|---|
| E wt fract | 0.718 | 0.000 | 0.000 | 0.000 | 0.000 | 0.077 | 0.103 | 0.103 | 1.000 |

The image quality of the prints (Table 4.2) was generally good as compared to TrueJet® ink jet paper. Densities were higher with the precoats than with the control. Grain was not always better than the TrueJet®, but the mottle was always better than the control.

TABLE 4.2

Image Quality of Example 4

| Print | Polymer Stabilizer | Thickness (gsm) | Max Cyan Density Mean | Max L(CIE) Graininess | Sum L(CIE) Graininess | Max L(CIE) Mottle | Sum L(CIE) Mottle |
|---|---|---|---|---|---|---|---|
| 1 | PolyminSK | 1.1 | 1.800 | 3.479 | 25.657 | 0.62 | 5.113 |
| 2 | Catiofast | 1.1 | 1.812 | 3.512 | 25.184 | 0.609 | 4.928 |
| 3 | DADMAC | 1.1 | 1.779 | 3.397 | 25.035 | 0.651 | 5.122 |
| 4 | AADAD | 1.1 | 1.790 | 3.673 | 26.737 | 0.676 | 5.383 |
| 5 | PolyminHM | 1.1 | 1.812 | 3.434 | 25.267 | 0.603 | 4.97 |
| | TrueJet | TrueJet | 1.507 | 4.013 | 30.124 | 0.996 | 7.335 |
| 6 | PolyminSK | 0.6 | 1.724 | 4.246 | 29.873 | 0.791 | 6.05 |
| 7 | Catiofast | 0.6 | 1.750 | 4.235 | 29.62 | 0.716 | 5.617 |
| 8 | DADMAC | 0.6 | 1.742 | 3.92 | 27.944 | 0.693 | 5.431 |
| 9 | AADAD | 0.6 | 1.723 | 3.982 | 28.358 | 0.695 | 5.569 |
| 10 | PolyminHM | 0.6 | 1.745 | 3.834 | 27.897 | 0.691 | 5.45 |
| | TrueJet | TrueJet | 1.507 | 4.013 | 30.124 | 0.996 | 7.335 |

gsm is grams per square meter

The dry rub durability of the prints was good, with little density loss as shown in Table 4.3. The wet abrasion was not as good as some results, such as in Example 2, and this is probably due to the low level of crosslinking provided by the silanol side groups on the Poval® R-1130 PVA. The Polymin® SK gave better wet abrasion performance compared to the other Examples.

TABLE 4.3

Durability of Example 4

| | | 4 Color Printer | | dry rub | dry rub Density | wet abrasion in drop % density | wet abrasion outside of drop loss | wet abrasion |
|---|---|---|---|---|---|---|---|---|
| | | | | Dry rub durability tested ~3 hr after printing. Wet rub testing after 40C/50% RH for 20 hr | | | | |
| Print | Polymer Stabilizer | Dry Laydown (gsm) | Black Dmax | % density loss | transfer to Dmin | loss in water drop | outside water drop | Density transferred to Dmin |
| 1 | PolyminSK | 1.1 | 1.94 | 2% | 0.000 | 19% | 5% | 0.07 |
| 2 | Catiofast | 1.1 | 1.93 | 0% | 0.000 | 21% | −4% | 0.02 |
| 3 | DADMAC | 1.1 | 1.82 | 0% | 0.000 | 38% | 16% | 0.02 |
| 4 | AADAD | 1.1 | 1.90 | −1% | 0.003 | 43% | 1% | 0.01 |
| 5 | PolyminHM | 1.1 | 1.92 | 0% | 0.003 | 20% | 5% | 0.11 |
| 6 | PolyminSK | 0.6 | 1.95 | 0% | 0.000 | 24% | 9% | 0.06 |
| 7 | Catiofast | 0.6 | 1.97 | −1% | 0.000 | 27% | 10% | 0.09 |
| 8 | DADMAC | 0.6 | 1.97 | −2% | 0.000 | 42% | 15% | 0.09 |
| 9 | AADAD | 0.6 | 1.96 | −1% | 0.003 | 31% | 5% | 0.08 |
| 10 | PolyminHM | 0.6 | 1.96 | −2% | 0.000 | 34% | 8% | 0.10 |
| | TrueJet | | 1.65 | −2% | 0.000 | 58% | 62% | 0.16 |

Example 5

Stabilization of Negatively Charged Silica (Ludox® AS) in High Levels of Calcium Chloride Aqueous Solutions Negatively charged silica was stabilized in high salt solutions of $CaCl_2$ using PEI. A comparison using PEI with positively charged Ludox® CL and negatively charged Ludox® AS by preparing the dispersions in Table 5.1. Unlike the acidification of the other components in these formulations, PEI was acidified with concentrated HCl because the amount required was so large.

TABLE 5.1

Comparison of positive and negative charged silica stabilized with PEI in $CaC1_2$. Final solids content was 10 wt % in water. Weight fraction is of the final solids of the dispersion.

| component | Olin 10G | CaCl2 | Polycup | R-1130 | PEI 60K Mn | Ludox$^R$ CL (30%) | Ludox$^R$ AS (30%) | total wt reagents |
|---|---|---|---|---|---|---|---|---|
| A wt fract | 0.001 | 0.696 | 0.003 | 0.060 | 0.120 | 0.120 | 0.000 | 1.000 |

TABLE 5.1-continued

Comparison of positive and negative charged silica stabilized with PEI in $CaC1_2$. Final solids content was 10 wt % in water. Weight fraction is of the final solids of the dispersion.

| component | Olin 10G | CaCl2 | Polycup | R-1130 | PEI 60K Mn | Ludox$^R$ CL (30%) | Ludox$^R$ AS (30%) | total wt reagents |
|---|---|---|---|---|---|---|---|---|
| B wt fract | 0.001 | 0.696 | 0.003 | 0.060 | 0.120 | 0.000 | 0.120 | 1.000 |

The dispersions were diluted to 5% solid aqueous and coated on a slot dye coating machine at three dispersion laydown levels, 1.5, 1.0, and 0.5 g/m$^2$ on SUG paper substrate. The image quality summary (Table 5.2) shows higher cyan density for the silica precoats on the SUG than the TrueJet® control. The grain for the positively charged silica precoats on SUG was about the same as the control while the precoats that contain the negative silica were not as good as the control. Cyan mottle was the same as the control for the negative particles in the precoat and better when the precoat contained the positively charged silica. The image quality was a function of precoat thickness.

TABLE 5.2

Image quality of formulations from Table 5.1

| Print | Coating Dispersion | Substrate | Precoat Thickness (gsm) | Max Cyan Density Mean | Max L(CIE) Graininess | Sum L(CIE) Graininess | Max L(CIE) Mottle | Sum L(CIE) Mottle |
|---|---|---|---|---|---|---|---|---|
| 1 | A | SUG | 1.5 | 1.691 | 3.232 | 21.46 | 0.751 | 5.935 |
| 2 | A | SUG | 1 | 1.675 | 3.458 | 22.653 | 0.991 | 6.667 |
| 3 | A | SUG | 0.5 | 1.656 | 4.069 | 26.003 | 1.001 | 6.998 |
| 4 | B | SUG | 1.5 | 1.627 | 3.825 | 25.138 | 1.085 | 7.704 |
| 5 | B | SUG | 1 | 1.623 | 3.971 | 26.255 | 1.101 | 7.726 |
| 6 | B | SUG | 0.5 | 1.627 | 4.649 | 29.34 | 1.327 | 8.539 |
| 7 | | TrueJet | | 1.431 | 3.347 | 23.346 | 1.132 | 8.01 |

gsm is grains per square meter

A similar set of experiments was carried out using a Z320 PVA with two crosslinkers. Table 5.3 describes two formulations with high salt levels of calcium chloride, negatively charged Ludox® AS silica, PEI as the stabilizer, and the crosslinkable Z-320 polymer binder. Polycup 172 was used in formulation A and glyoxyl based crosslinker Sequarez 755 F450 was used in formulation B. This procedure also employed a longer time of mixing of the PEI with the silica (4 hours instead of 2 hours) which included heating of the PEI/silica while stirring at 40° C. for 1 hour. The stable dispersions were coated in the usual manner on the micro-gravure coater.

TABLE 5.3

Formulations of Negatively Charged Silica in PVA with different crosslinkers. Final solids content was 15 wt % in water. Weight fraction is of the final solids of the dispersion.

| component | CaCl2 | Polycup 172 | Sequarez 755 F450 | PEI 60K Mn | Z-320 | LudoxAS | Silwet L-7602 | total wt reagents |
|---|---|---|---|---|---|---|---|---|
| C wt fract | 0.571 | 0.048 | 0.000 | 0.095 | 0.190 | 0.095 | 0.000 | 1.000 |

TABLE 5.3-continued

Formulations of Negatively Charged Silica in PVA with different crosslinkers. Final solids content was 15 wt % in water. Weight fraction is of the final solids of the dispersion.

| component | CaCl2 | Polycup 172 | Sequarez 755 F450 | PEI 60K Mn | Z-320 | LudoxAS | Silwet L-7602 | total wt reagents |
|---|---|---|---|---|---|---|---|---|
| D wt fract | 0.571 | 0.000 | 0.048 | 0.095 | 0.190 | 0.095 | 0.000 | 1.000 |

Solution C that contained the Polycup 172 crosslinker was coated twice on two separate days to test for repeatability. Solution D was coated only on the second day. The results in Table 5.4 show little difference between any of the coatings at the same thickness. The prints made with the silica containing precoat have better image quality than the TrueJet® mill treated paper. These results with the negatively charged Ludox® AS are similar to those seen for the positively charged silica Ludox® CL-P described in the previous Examples.

TABLE 5.4

Image Quality of Negatively Charged Silica in PVA with different crosslinkers.

| Print | Ctg Soln | Precoat Thickness (gsm) | Max Cyan Density Mean | Max L(CIE) Graininess | Sum L(CIE) Graininess | Max L(CIE) Mottle | Sum L(CIE) Mottle |
|---|---|---|---|---|---|---|---|
| 1 | C | 1.1 | 1.735 | 2.730 | 19.523 | 0.651 | 5.151 |
| 3 | C | 1.1 | 1.735 | 2.652 | 19.192 | 0.649 | 5.285 |
| 4 | D | 1.1 | 1.747 | 2.940 | 20.618 | 0.682 | 5.297 |
| 2 | C | 0.6 | 1.676 | 3.164 | 22.251 | 0.715 | 5.648 |
| 5 | C | 0.6 | 1.685 | 3.029 | 21.543 | 0.719 | 5.735 |
| 6 | D | 0.6 | 1.717 | 3.104 | 20.854 | 0.679 | 5.409 |
| 7 | Truejet | | 1.547 | 3.637 | 24.302 | 1.033 | 7.109 |

The durability of the prints as measured by dry rub and wet rub are shown in Table 5.5. The Sutherland dry rub durability is not as effective as TrueJet®, because PEI is not as mechanically stable as the PEI copolymer Polymin®SK used in the Examples above. Lubricant was not added to these coatings. The wet rub is better that TrueJet® probably due to the crosslinking of the Z320 PVA with either the Polycup 172 or the Sequarez 755.

TABLE 5.5

Summary of durability for prints on precoats with pure silica (Ludox ® AS)-PEI

| | | | 4 Color Printer | | Dry rub durability tested ~3 hr after printing. | | Wet rub testing after 40C/50% RH for 20 hr | |
|---|---|---|---|---|---|---|---|---|
| | | Paper | Dry Laydown | Black Dmax | dry rub % density loss | dry rub Density transfer to Dmin | wet abrasion in drop % density loss in water drop | wet abrasion outside of drop % density loss outside water drop |
| 1 | C | SUG | 1.1 | 2.00 | 41% | 0.107 | 33% | 23% |
| 3 | C | SUG | 1.1 | 2.00 | 30% | 0.050 | 11% | 3% |
| 4 | D | SUG | 1.1 | 2.06 | 75% | 0.097 | 7% | 7% |
| 2 | C | SUG | 0.6 | 1.89 | 44% | 0.043 | 2% | −1% |
| 5 | C | SUG | 0.6 | 1.89 | 31% | 0.023 | 0% | −1% |
| 6 | D | SUG | 0.6 | 1.90 | 46% | 0.060 | −1% | −3% |
| 7 | TrueJet | | 0.6 | 1.75 | −1% | 0.013 | 78% | 71% |

Example 6

Incorporation of Alumina into Silica Precoats with Calcium and Magnesium Chloride Alumina in the form of pseudo-boehmite was incorporated at 5% of the total dry coat weight along with 9 wt % cationic silica stabilized with Polymin® SK cationic polymer. Formulations A, B, and E contained calcium chloride while C and D employed magnesium chloride. Surprisingly, the magnesium salts in combination with the oxides gave better durability results than the formulations made with the calcium chloride.

TABLE 6.1

Formulations of Example 6. Final solids content was 15 wt % in water. Weight fraction is of the final solids of the dispersion.

| component | CaCl2 | MgCl2 | Polycup 172 | Polymin SK | Z-320 | ELV 52-22 | Ludox CL-P | Al 18N4-80 | Silwet L-7602 | Silwet L-7604 | total wt reag |
|---|---|---|---|---|---|---|---|---|---|---|---|
| A wt fract | 0.54 | 0.00 | 0.05 | 0.04 | 0.18 | 0.05 | 0.14 | 0.00 | 0.01 | 0.00 | 1.00 |
| B wt fract | 0.54 | 0.00 | 0.05 | 0.04 | 0.18 | 0.05 | 0.09 | 0.05 | 0.01 | 0.00 | 1.00 |
| C wt fract | 0.00 | 0.54 | 0.05 | 0.04 | 0.18 | 0.05 | 0.14 | 0.00 | 0.01 | 0.00 | 1.00 |
| D wt fract | 0.00 | 0.54 | 0.05 | 0.04 | 0.18 | 0.05 | 0.09 | 0.05 | 0.01 | 0.00 | 1.00 |
| E wt fract | 0.54 | 0.00 | 0.05 | 0.04 | 0.18 | 0.05 | 0.09 | 0.05 | 0.00 | 0.01 | 1.00 |

The image quality of prints made after precoats were placed on SUG and UB45 were comparable or better than prints made on the commercial inkjet papers TrueJet® and UBIJ.

TABLE 6.2

Image Quality of Example 6.

| Print | Ctg Soln | Precoat Thickness (gsm) | Max Cyan Density Mean | Max L(CIE) Graininess | Sum L(CIE) Graininess | Max L(CIE) Mottle | Sum L(CIE) Mottle |
|---|---|---|---|---|---|---|---|
| 1 | A | 1.1 | 1.635 | 2.500 | 19.323 | 0.664 | 5.366 |
| 2 | B | 1.1 | 1.639 | 2.680 | 19.991 | 0.704 | 5.422 |
| 3 | C | 1.1 | 1.659 | 2.720 | 19.835 | 0.685 | 5.589 |
| 4 | D | 1.1 | 1.659 | 2.833 | 20.932 | 0.722 | 5.611 |
| 5 | E | 1.1 | 1.624 | 2.559 | 19.061 | 0.709 | 5.769 |
| | TrueJet | TrueJet | 1.512 | 3.639 | 24.527 | 1.006 | 6.896 |
| 7 | A | 0.6 | 1.633 | 3.025 | 21.163 | 0.752 | 5.817 |
| 8 | B | 0.6 | 1.609 | 3.259 | 22.761 | 0.821 | 6.306 |
| 9 | C | 0.6 | 1.629 | 2.931 | 20.961 | 0.711 | 5.555 |
| 10 | D | 0.6 | 1.626 | 3.179 | 22.784 | 0.758 | 6.14 |
| 11 | E | 0.6 | 1.608 | 3.073 | 21.843 | 0.787 | 6.033 |
| | TrueJet | TrueJet | 1.512 | 3.639 | 24.527 | 1.006 | 6.896 |
| 13 | A | 0.6 | 1.398 | 2.962 | 22.175 | 0.804 | 6.405 |
| 14 | B | 0.6 | 1.370 | 3.365 | 24.207 | 1.012 | 6.761 |
| 15 | C | 0.6 | 1.401 | 2.875 | 22.047 | 0.918 | 6.666 |
| 16 | D | 0.6 | 1.38 | 3.148 | 22.859 | 1.06 | 6.522 |
| 17 | E | 0.6 | 1.376 | 2.949 | 22.387 | 0.866 | 6.502 |
| | UB-IJ | UB-IJ | 1.292 | 3.773 | 26.717 | 1.068 | 7.030 |

The image durability for these formulations was very good. Prints made on precoats C and D were particularly resistant to Sutherland dry rub and wet rub. These two samples both contained magnesium chloride in place of calcium chloride. The dry rub for these two formulations on SUG at the thick and thin precoat laydowns, and on UB45 was similar to commercial TrueJet and UBIJ inkjet papers. The wet abrasion for the oxide-magnesium chloride was much better than the commercial papers, with no real change caused by the water.

TABLE 6.3

Summary of Durability for Prints on oxide precoats with calcium and magnesium salts.

| | | | | Dry rub durability tested ~3 hr after printing. Wet rub testing after 40C/50% RH for 20 hr | | | | | |
|---|---|---|---|---|---|---|---|---|---|
| Print | Coating Solution | substrate Paper | coating laydown (gsm) Dry Laydown | black Dmax Black Dmax | dry rub % density loss | dry rub Density transfer to Dmin | wet abrasion in drop % density loss in water drop | wet abrasion outside of drop % density loss outside water drop | wet abrasion Density transferred to Dmin |
| 1 | A | SUG | 1.1 | 1.88 | 13% | 0.113 | 13% | −6% | 0.01 |
| 2 | B | SUG | 1.1 | 2.01 | 24% | 0.147 | 14% | 2% | 0.00 |
| 3 | C | SUG | 1.1 | 1.88 | 3% | 0.087 | 7% | −1% | 0.00 |
| 4 | D | SUG | 1.1 | 2.00 | 6% | 0.033 | 16% | 0% | 0.01 |
| 5 | E | SUG | 1.1 | 2.01 | 19% | 0.053 | 26% | −1% | 0.00 |
| 7 | A | SUG | 0.6 | 1.87 | 48% | 0.047 | −3% | −4% | 0.01 |
| 8 | B | SUG | 0.6 | 1.92 | 46% | 0.040 | −1% | −2% | 0.00 |
| 9 | C | SUG | 0.6 | 1.92 | −2% | 0.017 | −3% | −2% | 0.01 |
| 10 | D | SUG | 0.6 | 1.93 | −3% | 0.040 | −1% | −1% | 0.01 |
| 11 | E | SUG | 0.6 | 1.91 | 43% | 0.030 | −1% | −2% | 0.03 |
| 13 | A | UB45 | 0.6 | 1.41 | 0% | 0.017 | 8% | 6% | 0.01 |
| 14 | B | UB45 | 0.6 | 1.28 | −2% | 0.033 | 14% | 4% | 0.00 |
| 15 | C | UB45 | 0.6 | 1.23 | −1% | 0.023 | 13% | −2% | 0.01 |
| 16 | D | UB45 | 0.6 | 1.32 | −1% | 0.017 | 18% | 3% | 0.01 |
| 17 | E | UB45 | 0.6 | 1.41 | 1% | 0.030 | 10% | −2% | 0.01 |
| | TrueJet | | | 1.61 | −1% | 0.023 | 71% | 49% | 0.21 |
| | UBIJ | | | 1.28 | 0% | 0.010 | 43% | 19% | 0.02 |

Example 7

Gloss as a Function of Particle Size

75° gloss is shown for three silica precoat dispersions that were each prepared on a 20 kg scale according to the formulations in Table 7.1. Dispersion A used the polyurethane Printrite® DP376 and the silane substituted PVA Poval® R-1130 as the binder. Dispersion B contained R-1130 as the binder, and C increased the silica from 10 to 14 wt % of the solids.

TABLE 7.1

Formulations of Example 7. Final solids content was 15 wt % in water. Weight fraction is of the final solids of the dispersion.

| Component | CaCl2 | Polycup | Polymin SK | guargum | PrintRite DP376 | R-1130 | Ludox CL-P |
|---|---|---|---|---|---|---|---|
| A wt fract | 0.657 | 0.000 | 0.094 | 0.014 | 0.047 | 0.047 | 0.141 |
| B wt fract | 0.707 | 0.000 | 0.076 | 0.015 | 0.000 | 0.101 | 0.101 |
| C wt fract | 0.657 | 0.001 | 0.094 | 0.014 | 0.000 | 0.094 | 0.141 |

The three dispersions were coated on SUG paper substrate at two different laydowns, 1.1 and 0.6 g/m$^2$ using the Mini-Labo™ coater. Table 7.2 shows the results of the coating at 325 and 650 fpm for A and C. There was a slight increase in measured gloss for the coatings relative to the untreated SUG substrate. Dispersions A and C were also coated on SUG paper substrate using a Kodak PROSPER IOS unit. This is a commercial gravure coating station for treatment of paper substrates prior to in-line printing on a Kodak PROSPER press.

TABLE 7.2

Gloss measurements of silica precoats

Gloss of Silica Precoats on SUG coated with Mini-Labo ™

| coating soln | coating laydown (gsm) | Gloss Measurement 75° angle; |
|---|---|---|
| A | 1.1 | 74.9 |
| B | 1.1 | 72.6 |
| C | 1.1 | 70.6 |
| A | 0.6 | 72.7 |
| B | 0.6 | 72.6 |
| C | 0.6 | 71.0 |

Gloss of Silica Precoats on SUG coated with Kodak IOS Precoater

| coating soln | coating speed (ft/min) | dry coating laydown (gsm) | Gloss Measurement 75° angle; |
|---|---|---|---|
| A | 325 | 0.4 | 76.8 |
| A | 650 | 0.4 | 73.1 |
| C | 325 | 0.4 | 76.4 |
| C | 650 | 0.4 | 71.8 |

Particle sizing of the coating solutions was done by light scattering using a Horiba particle sizing instrument; the measured particle sizes were indicates particle size of 0.15 microns diameter. The small size of the particles and lack of large agglomerates contributes to the resulting gloss and transparency of the coatings.

Example 8

Silica Gel Treatment Coating and Gloss

A coating solution was made comprising 133.3 parts calcium chloride, 100 parts SYLOJET® C30F silica gel (Grace Davison), and 40 parts Celvol 203 (Celanese) polyvinyl alcohol. The formulation above is described in terms of dry solids; the total solids content of the solution is 15% by weight. This solution was applied to a glossy coated offset paper (NewPage Sterling Ultra gloss 80#, or SUG) using a MiniLabo™ gravure coater (Yasui Seiki Co.) fitted with a 150R micro gravure cylinder. The resulting inkjet receptive coating has a dry coat weight of approximately 1.1 gsm. The coated layer has the identical composition and similar laydown as the example described in US2011/0050827, but was not calendared as were examples in the referred application.

Using a BYK-Gardner microgloss75 gloss meter, the 75 degree gloss of the untreated SUG paper base was measured at 68 gloss units. The same paper treated as described above had a 75 degree gloss of 36 gloss units. This gloss decrease of the treated paper substrate is unacceptable for application of a treatment solution to a glossy paper substrate immediately before printing (in-line treatment). According to US2011/0050827, glossy treated paper substrates required calendaring to restore a portion of their original gloss. To do this in-line on a press would require installation of a calendar unit at a significant and undesirable increase in complexity and cost, both mechanically and operationally. In contrast, the treatment formulations described in the present application do not require calendaring to retain high paper gloss after treatment and so represent a preferred formulation for the in-line treatment of printing substrates.

The invention has been described with reference to a preferred embodiment. However, it will be appreciated that variations and modifications can be effected by a person of ordinary skill in the art without departing from the scope of the invention.

The invention claimed is:

1. An inkjet receiving element comprising a substrate having coated thereon a transparent topmost layer, wherein the topmost layer comprises (a) from 30 to 70 wt % of one or more aqueous soluble salts of multivalent metal cations, (b) from 5 to 20 wt % of a cross-linked hydrophilic polymer binder, (c) from 10 to 40 wt % of silica particles, and (d) from 4 to 12 wt % of a cationic polymer, wherein the silica particles have an average particle size less than 200 nm, wherein the weight ratio of cationic polymer to silica particles ranges from 1:1 at the uppermost salt concentration to 1:6 at the lowermost salt concentration, and wherein the topmost layer is present at a dry coverage in the range of 0.3 to 2.5 g/m$^2$.

2. The inkjet receiving element of claim 1, wherein the one or more multivalent metal salts comprise a calcium salt.

3. The inkjet receiving element of claim 2, wherein the topmost layer includes calcium ion equivalent to at least 50 wt % of calcium chloride.

4. The inkjet receiving element of claim 1, wherein the one or more multivalent metal salts comprise a magnesium salt.

5. The inkjet receiving element of claim 4, wherein the topmost layer includes calcium ion equivalent to at least 50 wt % of magnesium chloride.

6. The inkjet receiving element of claim 1, wherein the topmost layer is coated at a solid content of from 0.4 to 2 g/m$^2$.

7. The inkjet receiving element of claim 1, wherein the topmost layer is coated at a solid content of from 0.4 to 1.5 g/m$^2$.

8. The inkjet receiving element of claim 1, wherein the topmost layer is coated at a solid content of from 0.4 to 1.1 g/m$^2$.

9. The inkjet receiving element of claim 1, wherein the substrate is readily hydrophilic and capable of adsorbing and transferring ink colorant to the substrate interior prior to being coated thereon with the topmost layer.

10. The inkjet receiving element of claim 1, wherein the substrate includes a relatively hydrophobic surface prior to being coated thereon with the topmost layer and the topmost continuous layer provides a continuous relatively hydrophilic surface.

11. The inkjet receiving element of claim 10, wherein the substrate includes a plastic film.

12. The inkjet receiving element of claim 1, wherein the substrate is a coated offset paper.

13. The inkjet receiving element of claim 1, wherein the substrate is substantially impermeable to water or aqueous ink.

14. The inkjet receiving element of claim 1, wherein the cross-linked hydrophilic polymer includes a cross-linked aceto-acetylated polyvinyl alcohol polymer.

15. The inkjet receiving element of claim 14, wherein the cross-linked hydrophilic polymer includes an aceto-acetylated polyvinyl alcohol polymer cross-linked with a glyoxal compound.

16. The inkjet receiving element of claim 14, wherein the cross-linked hydrophilic polymer includes an aceto-acetylated polyvinyl alcohol polymer cross-linked with an azetidinium ring containing polymer.

17. The inkjet receiving element of claim 1, wherein the silica in the topmost layer is colloidal silica.

18. The inkjet receiving element of claim 1, wherein the silica in the topmost layer is colloidal silica that carries a negative surface charge.

19. The inkjet receiving element of claim 1, wherein the silica in the topmost layer is colloidal silica that carries a positive charge.

20. The inkjet receiving element of claim 1, wherein the silica stabilizer in the topmost layer is a cationic polymer.

21. The inkjet receiving element of claim 20, wherein the silica stabilizer in the topmost layer is acidified polyethyleneimine.

22. The inkjet receiving element of claim 20, wherein the silica stabilizer in the topmost layer is acidified polyethyleneimine copolymers.

23. The inkjet receiving element of claim 1, wherein the fraction of stabilizer is between about 30 and 100 wt % of the silica in the topmost layer.

24. The inkjet receiving element of claim 1, wherein alumina is incorporated as pseudo boehmite in place of up to 50 wt % of the silica.

25. The inkjet receiving media of claim 1, wherein the one or more multivalent metal salts includes a cation selected from $Mg^{+2}$, $Ca^{+2}$, $Ba^{+2}$, $Zn^{+2}$, or $Al^{+3}$.

26. The inkjet receiving media of claim 1, wherein the one or more multivalent metal salts comprise $CaCl_2$, $Ca(CH_3CO_2)_2$, $MgCl_2$, $Mg(CH_3CO_2)_2$, $Ca(NO_3)_2$, or $Mg(NO_3)_2$, or hydrated versions of these salts.

27. An inkjet receiving element in accordance with claim 1 comprising a substrate having coated thereon a transparent topmost layer, wherein the topmost layer includes:

(a) 56 wt % of aqueous soluble salts of multivalent metal cations, (b) 19 wt % of a cross-linked hydrophilic polymer binder, (c) 14 wt % of a cationic silica particle, and (d) 5 wt % of a cationic polymer, wherein the topmost layer is present at a dry coverage in the range of 0.4 to 1.1 $g/m^2$.

28. An inkjet receiving element in accordance with claim 1 comprising a substrate having coated thereon a transparent topmost layer, wherein the topmost layer includes:

(a) 57 wt % of aqueous soluble salts of multivalent metal cations, (b) 19 wt % of a cross-linked hydrophilic polymer binder, (c) 10 wt % of a anionic silica particle, and (d) 10 wt % of a cationic polymer, wherein the topmost layer is present at a dry coverage in the range of 0.4 to 1.1 $g/m^2$.

29. A method of printing on a medium comprising:

a) providing an inkjet receiving element in accordance with claim 1, and b) using an inkjet printer to print at least one pigment-based colorant in an aqueous ink composition wherein the pigment-based colorant is self-dispersed or stabilized using anionic dispersants.

30. The method of claim 29, comprising transporting the inkjet receiving media by the inkjet printhead that is continuously applying the ink composition onto the receiving medium, and subsequently transporting the printed receiving medium through a drying station.

31. The method of claim 30, in which the inkjet printer is a continuous high-speed commercial inkjet printer applying colors from at least two different print heads in sequence in which different colored parts of an image printed on the inkjet-receiving medium are registered.

* * * * *